US012338626B1

(12) United States Patent
Neumayr

(10) Patent No.: US 12,338,626 B1
(45) Date of Patent: Jun. 24, 2025

(54) MODULAR WALL PANEL WITH INTEGRATED CHANNELS

(71) Applicant: Michael Neumayr, Los Angeles, CA (US)

(72) Inventor: Michael Neumayr, Los Angeles, CA (US)

( * ) Notice: Subject to any disclaimer, the term of this patent is extended or adjusted under 35 U.S.C. 154(b) by 0 days.

(21) Appl. No.: 18/749,182

(22) Filed: Jun. 20, 2024

(51) Int. Cl.

| | |
|---|---|
| ***E04C 2/32*** | (2006.01) |
| ***E04B 2/00*** | (2006.01) |
| ***E04C 2/52*** | (2006.01) |
| *E04C 2/34* | (2006.01) |

(52) U.S. Cl.
CPC ..... *E04C 2/32* (2013.01); *E04C 2/322* (2013.01); *E04C 2/324* (2013.01); *E04C 2/326* (2013.01); *E04C 2/46* (2013.01); *E04C 2/521* (2013.01); *E04C 2/525* (2013.01); *E04C 2002/3444* (2013.01); *E04C 2002/3455* (2013.01); *E04C 2002/3472* (2013.01)

(58) Field of Classification Search
CPC . E04C 2/32; E04C 2/322; E04C 2/324; E04C 2/326; E04C 2/46; E04C 2/521; E04C 2/525; E04C 2002/3444; E04C 2002/3455; E04C 2002/3472
See application file for complete search history.

(56) References Cited

U.S. PATENT DOCUMENTS

| | | | | | |
|---|---|---|---|---|---|
| 1,191,863 | A * | 7/1916 | Williams | E04C 2/32 | 52/630 |
| 2,391,997 | A * | 1/1946 | Noble | E04C 2/326 | 244/119 |
| 3,218,773 | A * | 11/1965 | Heirich | E04C 2/322 | 52/95 |
| 3,408,779 | A * | 11/1968 | Allen | E04C 2/32 | 52/630 |
| 4,889,758 | A * | 12/1989 | Rinkewich | B29D 24/00 | 52/789.1 |
| 4,962,622 | A * | 10/1990 | Albrecht | E04C 2/08 | 52/630 |
| 5,894,045 | A * | 4/1999 | Desrondiers | B32B 3/12 | 52/793.1 |
| 8,161,697 | B1 | 4/2012 | McDonald | | |
| 9,249,572 | B2 | 2/2016 | Neumayr | | |
| 9,790,684 | B2 * | 10/2017 | Neumayr | E04C 2/322 | |
| 10,077,553 | B2 | 9/2018 | Neumayr | | |

(Continued)

FOREIGN PATENT DOCUMENTS

| | | | | |
|---|---|---|---|---|
| CA | 2937630 | A1 * | 1/2017 | B32B 13/06 |
| EP | 0892122 | A2 * | 1/1999 | |
| KR | 20100012519 | A * | 2/2010 | |

*Primary Examiner* — Jessie T Fonseca
(74) *Attorney, Agent, or Firm* — Carmody MacDonald P.C.; Dennis J M Donahue, III; Kevin C. Staed

(57) ABSTRACT

The present disclosure includes a prefabricated wall panel that is made from materials which are otherwise waste products in the agricultural and forestry industry. Each wall panel includes lateral and longitudinal channels with a step in the sidewalls thereof to accommodate installation of various items. Some of the sidewalls may also include an additional step further recessed into the channel to accommodate other items. Regardless of the number channels and steps therein, the wall panels are also devoid of any shear sharp corner, such that a curved section is provided between each transition to allow for easier manufacturing with composite materials.

27 Claims, 26 Drawing Sheets

(56) References Cited

U.S. PATENT DOCUMENTS

| | | | | |
|---|---|---|---|---|
| 10,378,207 | B2 | 8/2019 | Gonda | |
| 10,563,400 | B2 * | 2/2020 | Graham | B32B 3/20 |
| 11,519,173 | B2 | 12/2022 | Hinkle et al. | |
| 2009/0235601 | A1 * | 9/2009 | Mellett | E04C 2/36 52/426 |
| 2010/0146884 | A1 * | 6/2010 | Lu | E04C 2/324 52/220.2 |
| 2012/0317923 | A1 * | 12/2012 | Herdt | E04B 1/80 264/261 |
| 2017/0121976 | A1 * | 5/2017 | Neumayr | E04C 2/324 |
| 2017/0335567 | A1 * | 11/2017 | Chugh | E04C 2/526 |
| 2019/0010699 | A1 * | 1/2019 | Chugh | E04C 2/521 |

* cited by examiner

Section E-E

Section F-F

Section I-I

Section J-J 46
48
44a
44b
50
20b
20a
Section A-A 78
42b
38
20c
42a
20b
20a
Section B-B 12
B
A
18a
18b
30
18c
18d
22
78
32
34

18a
18b
18c
18d
22
78
12
32
28
34

Detail A

Section B-B

Section D-D

Detail C

Section H-H

Detail H

Section B-B

Section C-C

Detail A

Section A-A

Section B-B

Detail C

Section A-A

Section A-A

Section B-B

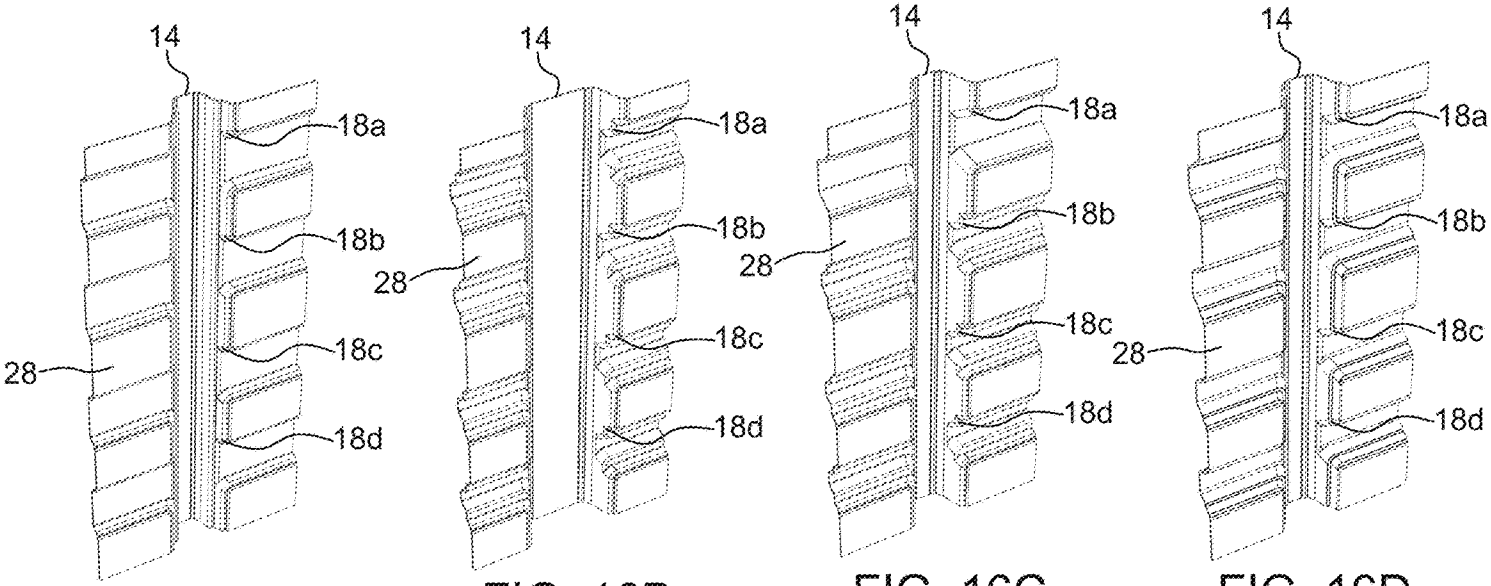
FIG. 16A
FIG. 16B
FIG. 16C
FIG. 16D
FIG. 16E
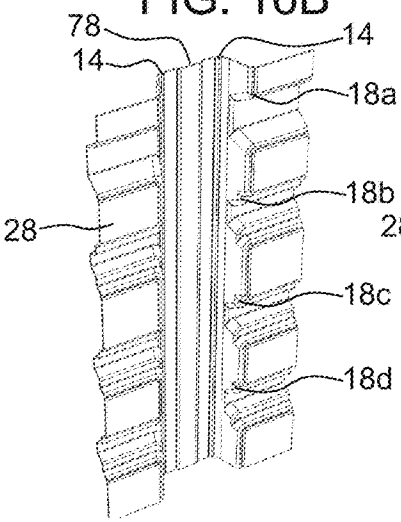
FIG. 16F
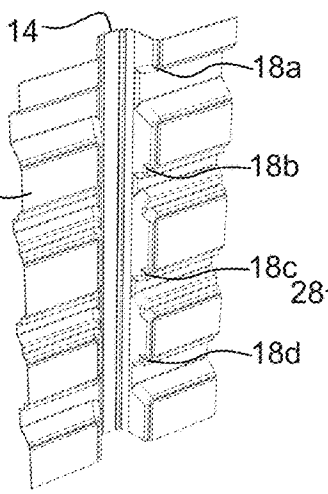
FIG. 16G
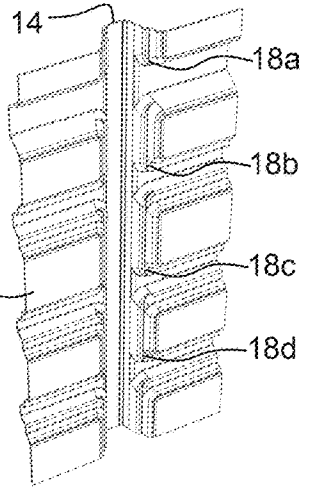
FIG. 16H

MODULAR WALL PANEL WITH INTEGRATED CHANNELS

CROSS-REFERENCE TO RELATED APPLICATIONS

This application is an original filing of the invention and does not claim a right of priority to any other application or the benefit of an earlier filing date.

STATEMENT REGARDING FEDERALLY SPONSORED RESEARCH

Not Applicable.

APPENDIX

Not Applicable.

BACKGROUND OF THE INVENTION

Field of the Invention

The present invention pertains to modular wall panels formed with installation channels for various conduits and junctions, including electrical power, electrical communication, plumbing, central vacuum, and heating, ventilation and air conditioning (HVAC).

Related Art

The invention relates to prefabricated modular building construction and units utilized in that construction. Prefabricated building components are used for construction because of their efficiency in installation which can potentially have expense cutting aspects and the reduction in the depletion of natural resources.

Historically the use of two by four (2×4) studs of wood or other lumber of standard dimensions were most commonly used to fabricate the interior and exterior portions of buildings. Skilled tradesmen and a significant amount of time are needed for the fabrication of buildings by this traditional method of building construction. While prefabricated walls made from studs are available, the weight of the units makes them less efficient for installation. These prefabricated walls do not overcome the issue of the depletion of natural resources because they use standard lumber, the manufacturing of which involves a significant amount of waste material. Due to the weight and size of these types of prefabricated walls there are issues with shipping and storage. Furthermore, the continuous use of lumber in construction of prefabricated wall systems inadequately addresses global challenges of ever increasing lumber shortages and high materials cost despite decreasing lumber quality, due to droughts, beetle infestations and wild fires caused by climate change. The installation of elements such as electrical, plumbing, and heating and cooling elements requires drilling, threading, blocking or other time consuming methods for installation because there are no channels for the horizontal placement of these systems.

Standard stud framed walls, require a complete new electrical, plumbing and HVAC systems design for every new building design because there is no system available which standardizes these kinds of installation which not only create unnecessary logjams and time consuming coordination between mechanical, electrical and plumbing trades but also is prone to cause miscommunication, mistakes and conflicts that would be minimized through a more standardized approach that reduces cost and time spent fixing problems. Additionally, stud framed walls are very limiting regarding the placement of electrical junction boxes ("j-box") because boxes typically need to be attached to the side of a stud, installed with some sort of blocking between studs or special brackets to be mounted in the desired location between two adjacent studs. Furthermore, standard stud framed walls provide limited attachment points for hanging heavy cabinetry, which are predominately mounted directly to the studs. There is therefore a desire for a wall panel and system that increases the mounting options and minimizes the need for extra blocking or braces to mount j-boxes anywhere along a wall to save on installation time and material. There is also a desire for a wall panel and system that significantly increases the area where heavy items can be wall mounted by offering a continuous corrugated panel made of strong and durable composite materials to provide almost unlimited options to attach heavier items anywhere on the panel.

Other systems using prefabricated walls use materials such as metal sheets or poured concrete or cement forms. These types of systems have been unable to overcome the need for skilled tradesmen for installation. Additionally, the prefabricated components are heavy and are unable to be installed without the use of specialty equipment such as cranes, lifts, or other heavy mechanical equipment. In addition, many of the systems have been unable to accommodate plumbing, electrical, and HVAC or make it difficult to install these systems because of the inability to directly install without feeding the systems through complex or small openings. Many of the systems additionally have not been made of materials that help cut costs and reduce the use of non-renewable resources, or are cumbersome and installation is inconvenient and time consuming. As the construction industry is struggling worldwide with labor shortages, high labor cost, high material costs due to lumber shortages, long building time and low profitability, a modular building system is needed to help ameliorate these challenges.

Panels in the prior art include U.S. Pat. Nos. 9,249,572, 9,790,684 and 10,077,553 by Neumayr which describe wall assemblies made from corrugated wall panels that have various channels for plumbing, electrical, and HVAC installations. Another panel system in the prior art is described in U.S. Pat. No. 10,563,400 by Graham. This prefabricated structural building panel describes a wall panel with multiple channels and a step within the channel to accommodate electrical boxes. However, the channel and steps in the '400 Patent are limited given they are so far recessed into the channel that they can only be used to receive an electrical box and cannot readily function to close the open channels, to create a continuous solid front surface or readily accommodate other mounting brackets for plumbing and electrical components that are necessarily closer to the front face of the panel.

The '400 Patent is suited for very limited electrical installations only, as the channel width, per suggested dimensions, does not provide sufficient space to fit standard j-boxes of different sizes that are customarily used by those in the art. Instead, the '400 Patent is limited to a 1-gang or a 2-gang 4S j-boxes which have standard dimensions of four by four inches (4"×4"). Switch clusters, which are customarily oriented in lateral direction and located next to a door opening, often need to fit up to a 6-gang j-box which is considerably wider than the space provided in the '400 Patent. In addition, based on the dimensions given in FIG. 5 and as illustrated in FIG. 3 of the '400 Patent, the suggested ledges in the sidewalls provide inadequate dimensioned resting points for standard j-boxes wherein standard j-boxes of the most customarily used dimensions would fit within the opening width of the channel but would not be able to straddle the distance between the ledges as suggested. Thus, the prescribed box would difficult to install as it would need additional back support to position the front of the box flush with the front of the panel. Furthermore, if a j-box would be able to straddle the distance between both ledges as suggested, screws would be exposed as they would have to make up the distance between the ledge, the backside of the J-box and the bottom of the channel in order to attach the box to the bottom of the channel. These exposed screws would not be considered the correct way of installing a J-box and the '400 Patent therefore fails to provide an adequate solution to those in the art in need of improved modular wall panels.

Further still, the '400 Patent does not provide a solution to cross thread electrical wiring horizontally to connect j-boxes for wall outlets, which are by code to be positioned every eight feet (8') and are customarily also wired in lateral direction. The '400 Patent further limits its plumbing pipe diameter to a diameter of one and one half inch (1½"), which limits the application to the installation of sinks where pipes of greater diameter for waste water lines for showers, bathtubs, washers, or toilets, required by code of a minimum two inches (2") in diameter in certain regions. According to the teachings of FIG. 5 of the '400 Patent, the longitudinal channel provides no solution to feed pipes horizontally, which is a prerequisite for the code compliant installation of vent pipes and wastewater main stack assemblies as needed for toilet installations and which customarily require a minimum interior pipe diameter size of three inches (3") and thereby require significantly wider installation space than five inches (5"). In addition, there is no option to run fresh water, waste water and vent lines both side by side vertically as well as horizontally, which make the '400 Patent virtually unsuitable for the most standard plumbing installation to comply with IPC or UPC codes.

Prior art like U.S. Pat. No. 9,249,572 by Neumayr and the 400' Patent by Graham also fail to provide a practical solution to mount multiple electrical j-boxes and waste water plumbing lines simultaneously at varying installation depths and different vertical installation heights, in the same channel. Similarly, they do not provide a solution to run multiple large diameter waste water pipes of varying diameters, in the same longitudinal channel parallel to one another, as needed for standard toilet installs. Prior Art such as U.S. Pat. No. 9,010,054 by Herdt and U.S. Pat. No. 10,077,553 by Neumayr show narrow installation cannels and the transitions between the longitudinal to the lateral channels are either at sharp ninety degree (90°) angles, which offer insufficient space for rigid electrical conduit, which have a minimum bending radius of four inches (4"), and plumbing fittings of larger curvature such as elbows, sweeps or sanitary-T's or W's. In order to avoid pipe crossings or crossings of rigid electrical conduits and to be able to run these fittings parallel to one another, the transitions between the longitudinal and lateral channels need to be able to provide a sufficiently large curvature to accommodate the large bend radii of these objects to allow for a space saving install of pipes close to the sidewalls of the channels. This space is paramount as it allows for sufficient additional installation space for standard drain pipe and vent pipe configuration where large diameter wastewater and vent pipes need to be placed parallel to one another. In addition, both plumbing pipes and electrical conduits need to be secured in place which is customarily done via plumber's tape or other means of fastening. To achieve a secure attachment to the panel, the various pipes need to be close to the sidewalls of the channels for such attachment to the panel can occur.

The above mentioned '054 Patent, '572 Patent, '684 Patent and '553 Patent also suggests sharp edged surface transitions and various design details like ridges in the horizontal channel, which are only found on the frontside of the corrugated panel, and thickened which fail to meet moldability requirements of bio-based strand materials. The design details as suggested in the '553 Patent, specifically the thickened frames cannot be formed with state-of-the-art production methods and would not allow for a consistent density. If the thickened side frames and top and bottom frames were to be formed to a thickness greater than the overall panel thickness, which would negatively affect the internal bond strength between the various strand layers, the ninety degree (90°) deformation of the strand mat at the side edges of the panel, which is needed to create these thickened edges, would cause breakage and shear thinning of the strands and render the panel unsuitable to provide the needed structural integrity. Accordingly, there is a desire in the art to provide an improved wall panel with particular features that ease installation and manufacturing and provide a better end product.

SUMMARY OF THE INVENTION

According to various aspects of the present disclosure, there are provided multiple descriptions of the present invention. The present disclosure includes a prefabricated wall panel that can be made from fast growing plant fibers or from materials which are otherwise waste products in the agricultural and forestry industry. Examples of natural fast growing plant fibers, agricultural and forestry by-products, and waste products include wood chips, wood strands, wood particles, wood wafers, bagasse, coconut husk, straw, hemp, sorghum grass, corn husks, corn stalks or corn stover, agave, coconut or bamboo, or similar suitable natural fibers, i.e., organic-based composite materials. The present system also helps in overcoming the need for waste disposal of these byproducts in their respective industries. As there is an urgent need in the construction industry to reduce carbon emission through long time carbon storage to ameliorate the negative effects of climate change, the present system can be made of waste from forest management, such as beetle infested trees, small diameter timber, and burned logs left over from forest fires which cannot otherwise be readily used by the timber industry. The present system not only provides long time carbon storage by capturing carbon in corrugated wall panels but it also gives these materials commercial value. Using wood waste from forest management activities creates and incentivizes the removal of overabundant forest waste which will greatly reduce the risk of wildfires, an ever-growing international threat caused by climate change. At the same time, the removal of these materials helps restore biodiversity and provides the grounds for a healthy and resilient forest and reforestation efforts which would not be possible without the removal of forest waste. In addition, the option to make the panels described herein from forest waste creates a demand for these waste products which reduces carbon emission as unwanted material is usually burned by the forest service, releasing additional $CO_2$ into the atmosphere.

In addition to overcoming the need to utilize the waste associated with the above disclosed industries, utilizing these plant fibers generates a second form of income for farmers and companies in these industries as the byproducts of farming can now be utilized as viable building materials. The use of this abundant waste product allows for the construction of the present invention to be lower in terms of raw materials costs, lower production prices, and higher profit margins for manufactures enabling a delivery of a sustainable product of equal or lower cost than conventional lumber or prefabricated metal and concrete structures. These prefabricated structures can be utilized in both new and redesigned structures because of the unique way the prefabricated structures enable all components in modern buildings (electrical, plumbing, central vacuum, and HVAC) to be run through the structures. Additionally, color coded areas, human readable indicia, and/or machine readable indicia can be shown on the panel as described in detail below which enables the ease of construction by identifying the location of electrical and/or plumbing components and can reduce waste.

The wall panels of the present disclosure are preferably sized to be equal or similar to standard building materials and thus can be installed by one or two workers, eliminating the need for cranes, advanced delivery systems and installation materials, overcoming some of the obstacles of other prefabricated systems. The panels are capable of being cut to length so that they can be utilized to build a particular desired sized structure. Additionally, the openings for windows, doors and other portal elements can be cut into the structures for installation of these additional elements in construction or created by assembling prefabricated wall modules, headers and window sills.

The panels can be mixed with conventional framing techniques and used in concert with conventional tools for installation reducing the need for a set of separately skilled laborers for the installation. Many of the other prefabricated systems, using metal or other materials are unable to accommodate horizontal and vertical installation of electrical, plumbing, central vacuum and HVAC systems. In addition, the way the channels are formed eliminates the need to thread these systems through the preformed panels and provides a planar mounting surface, parallel to the front face of the panel, set at a standard depth of the most commonly used electrical boxes, at the correct and code compliant mounting height and depth. Thus, enabling the current invention to partner in both new and existing structures, while reducing time and the need for additional blocking, drilling, fishing, and feeding.

According to one aspect of the invention described herein, each channel has a step on both sidewalls proximate to the front face and in another embodiment at least one sidewall of one of the channels has at least one other step to accommodate various installation brackets and boxes at multiple positions within the channel.

According to another aspect of the invention described herein, each transition between the various faces on the front and back of the panel has a curve, without any sharp corner. By providing curvatures at surface and channel transitions, where the curvatures are measurably larger, the further the transition is located from the front face of the corrugated panel towards the backside of the corrugated panel, it allows to overcome several issues, such as providing needed space to accommodate both plumbing pipes and elbows and rigid electrical elbows, to be located close to the sidewalls and therefor provide sufficient installation space for various pipes. The pipes can run parallel in one channel and one or more of the pipes can transition into another channel that intersects perpendicular to the first channel, Furthermore the curved curvatures overcome shear thinning of the strand mat at sharp corner transitions.

According to another aspect of the invention described herein, some of the channel sidewalls can include an indent portion that allows for further connection of brackets and the like that are installed within the channels.

According to another aspect of the invention described herein, the corners of the panel are recessed from the front face.

According to yet another aspect of the invention described herein, floor and mid lines are marked on the front of each panel and a vertical centerline is marked on the front of each panel. The lines are either printed, stenciled, debossed, embossed, milled, engraved, or otherwise placed on the front face of the corrugated panel, such as with a sticker, following the full panel contour. The panel can also feature machine readable and/or scannable indicia, such as barcodes, QR codes, non fungible tokens (NFTs), or the like.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore, the drawings are not necessarily to scale. In addition, in the embodiments depicted herein, like reference numerals in the various drawings refer to identical or near identical structural elements.

FIGS. 11 and 1J respectively show a front and back perspective view of yet another embodiment of the invention with a wall panel having a ledge within each channel sidewall.

FIGS. 16A-16H show front perspective views of wall panels having alternative channel configurations for plumbing installations according to embodiments of the invention described herein.

DETAILED DESCRIPTION OF THE PREFERRED EMBODIMENTS

Figures 1A, 1B, 1C, 1D:
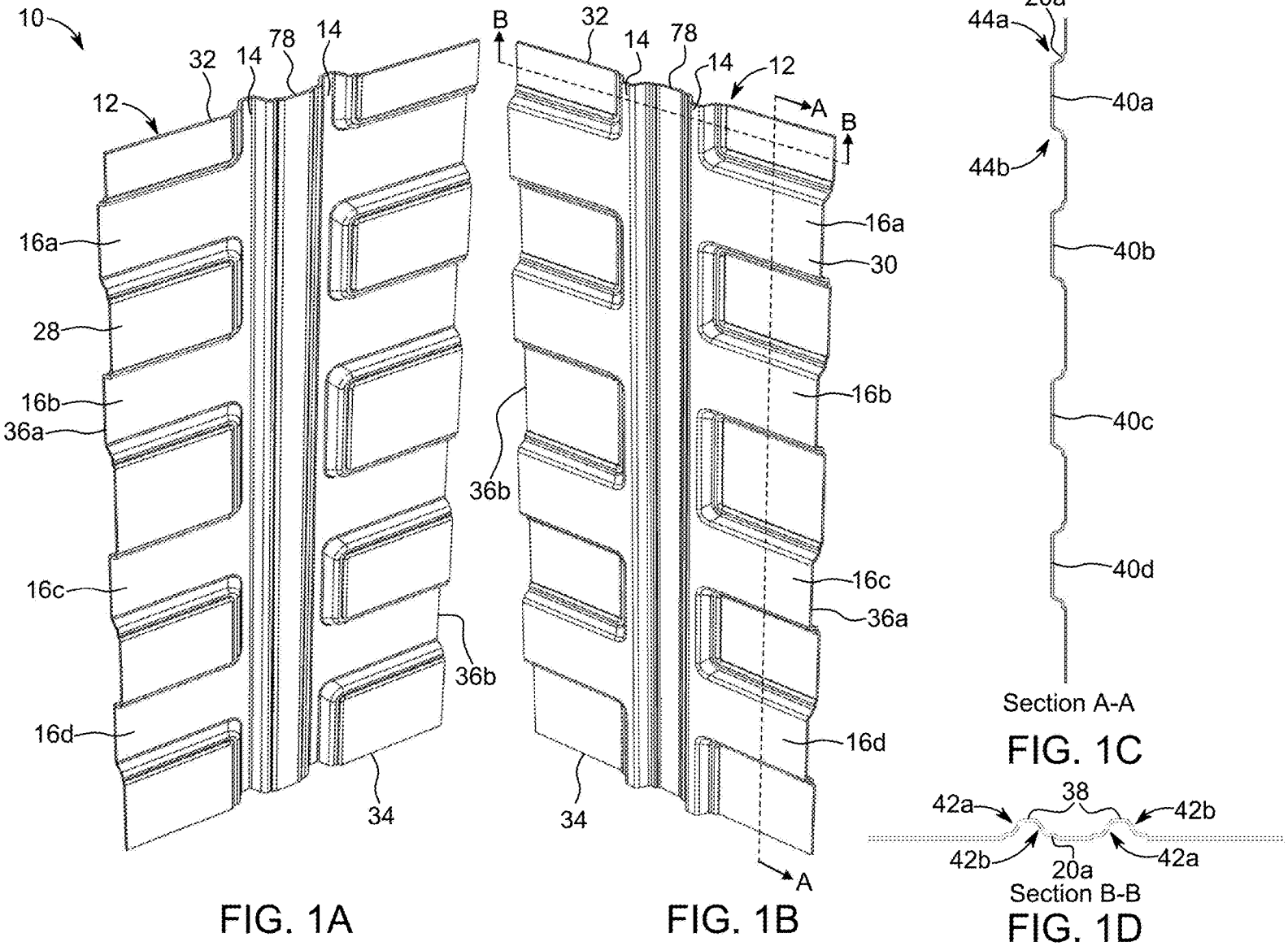
FIGS. 1A and 1B respectively show a front and back perspective view of a wall panel having a ledge within each channel sidewall according to an embodiment of the invention described herein.
FIGS. 1C and 1D respectively show side and top section views of a portion of the wall panel shown in FIGS. 1A and 1B.
Figure 1G:
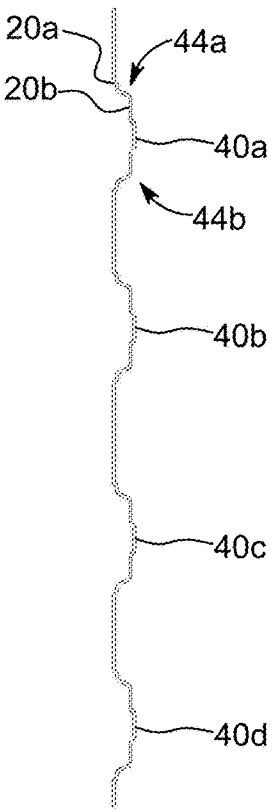
FIGS. 1G and 1H respectively show side and top section views of a portion of the wall panel shown in FIGS. 1E and 1F.
Figure 1H:
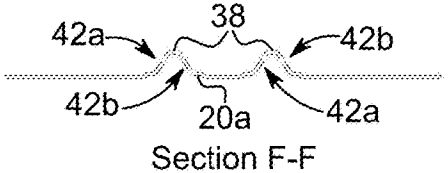
Figure 1F:
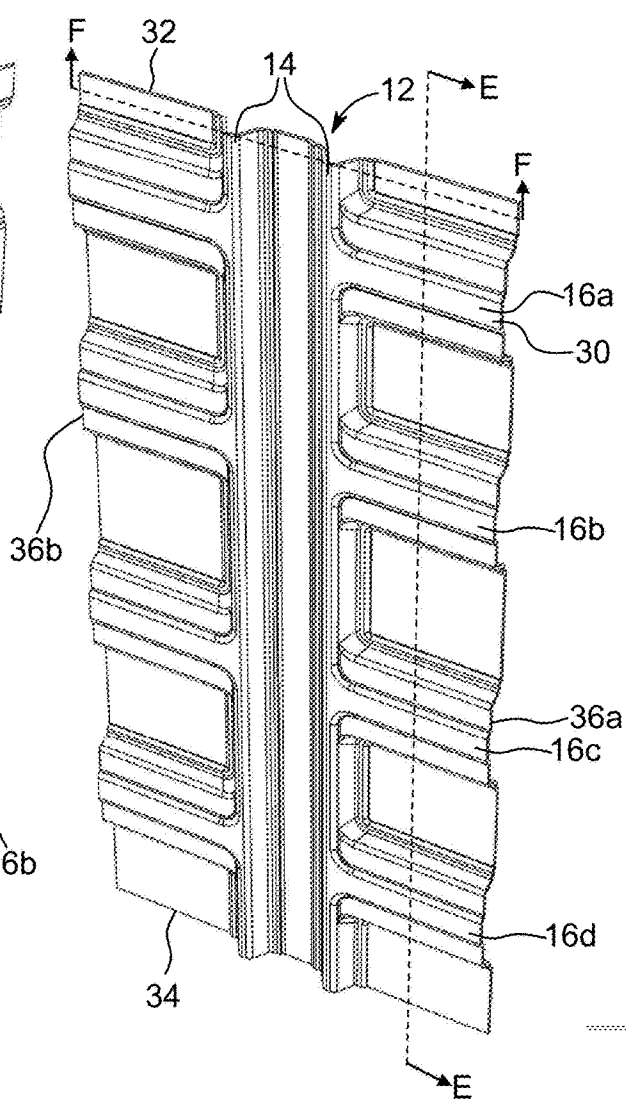
FIGS. 1E and 1F respectively show a front and back perspective view of another embodiment of the invention with a wall panel having a ledge within each channel sidewall.
Figure 1E:
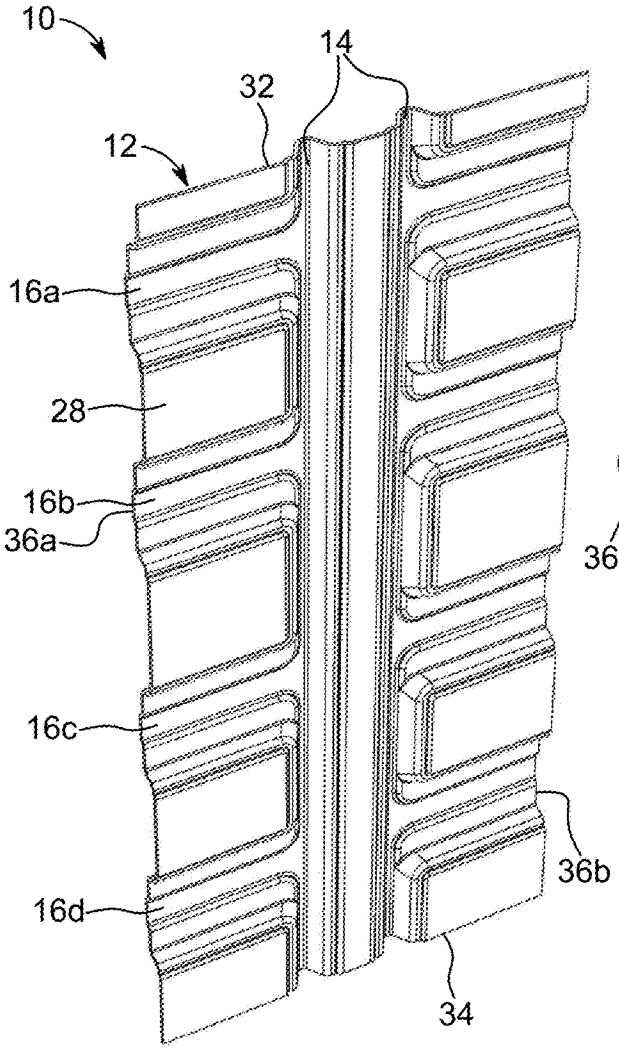
Figure 1K:
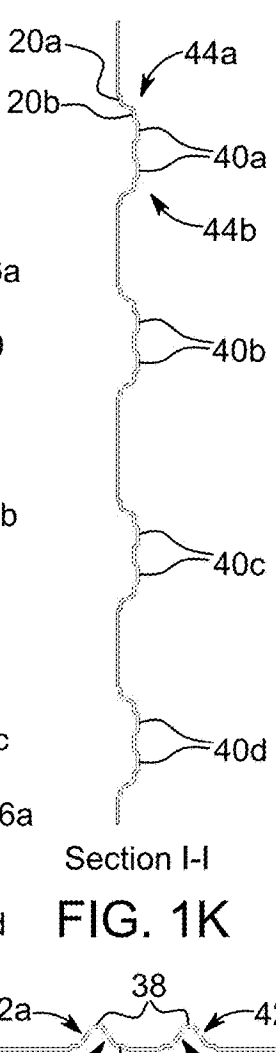
FIGS. 1K and 1L respectively show side and top section views of a portion of the wall panel shown in FIGS. 11 and 1J.
Figure 1L:
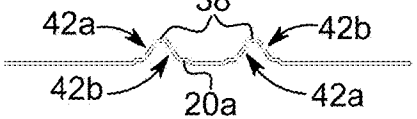
Figure 1J:
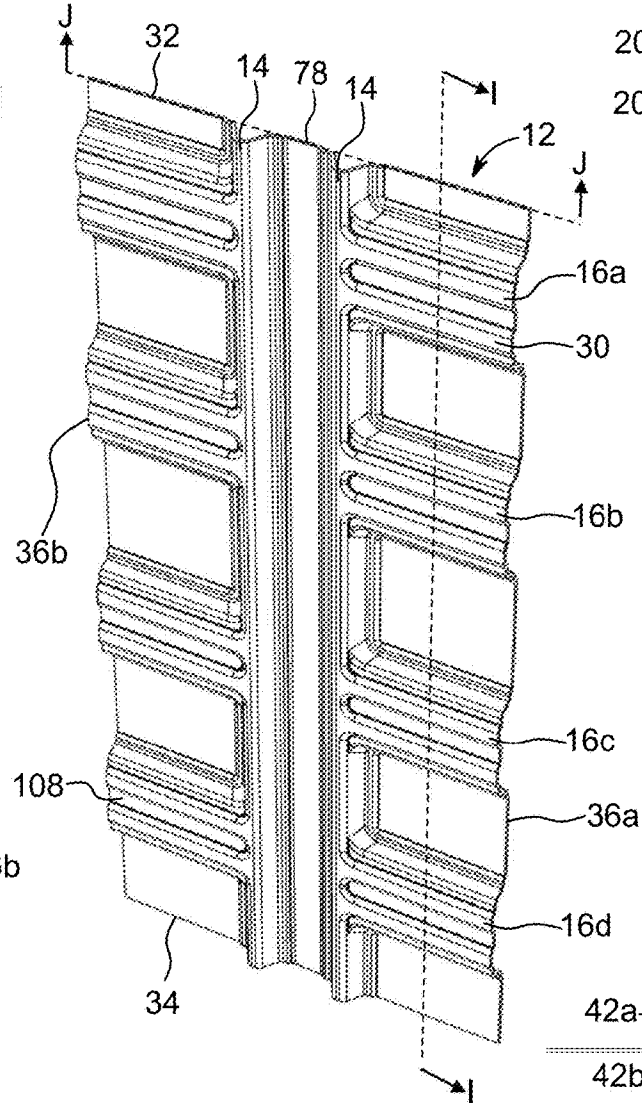
Figure 1I:
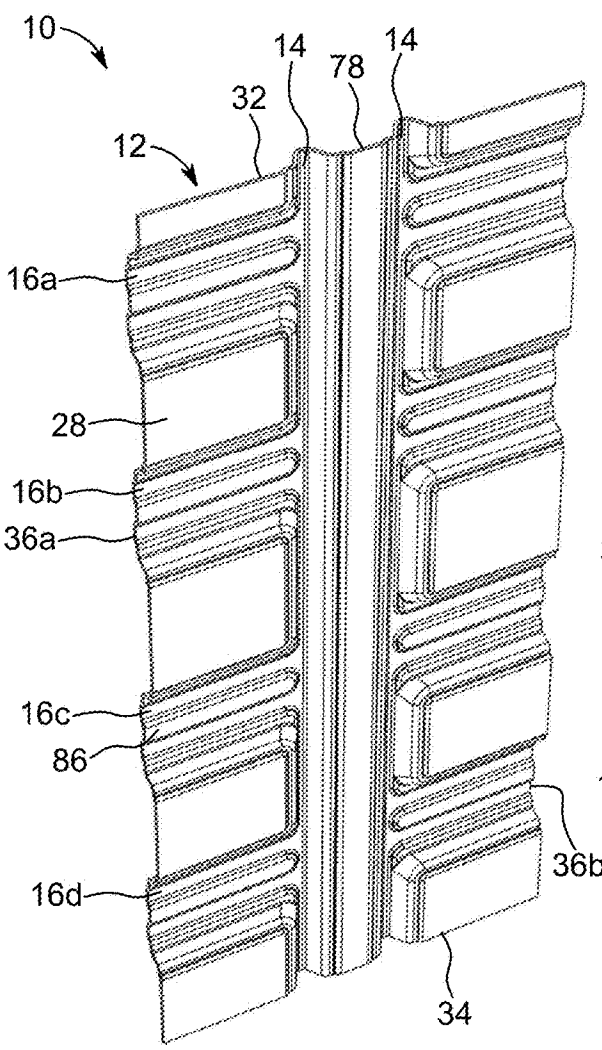
Figures 2A, 2B, 2C, 2D:
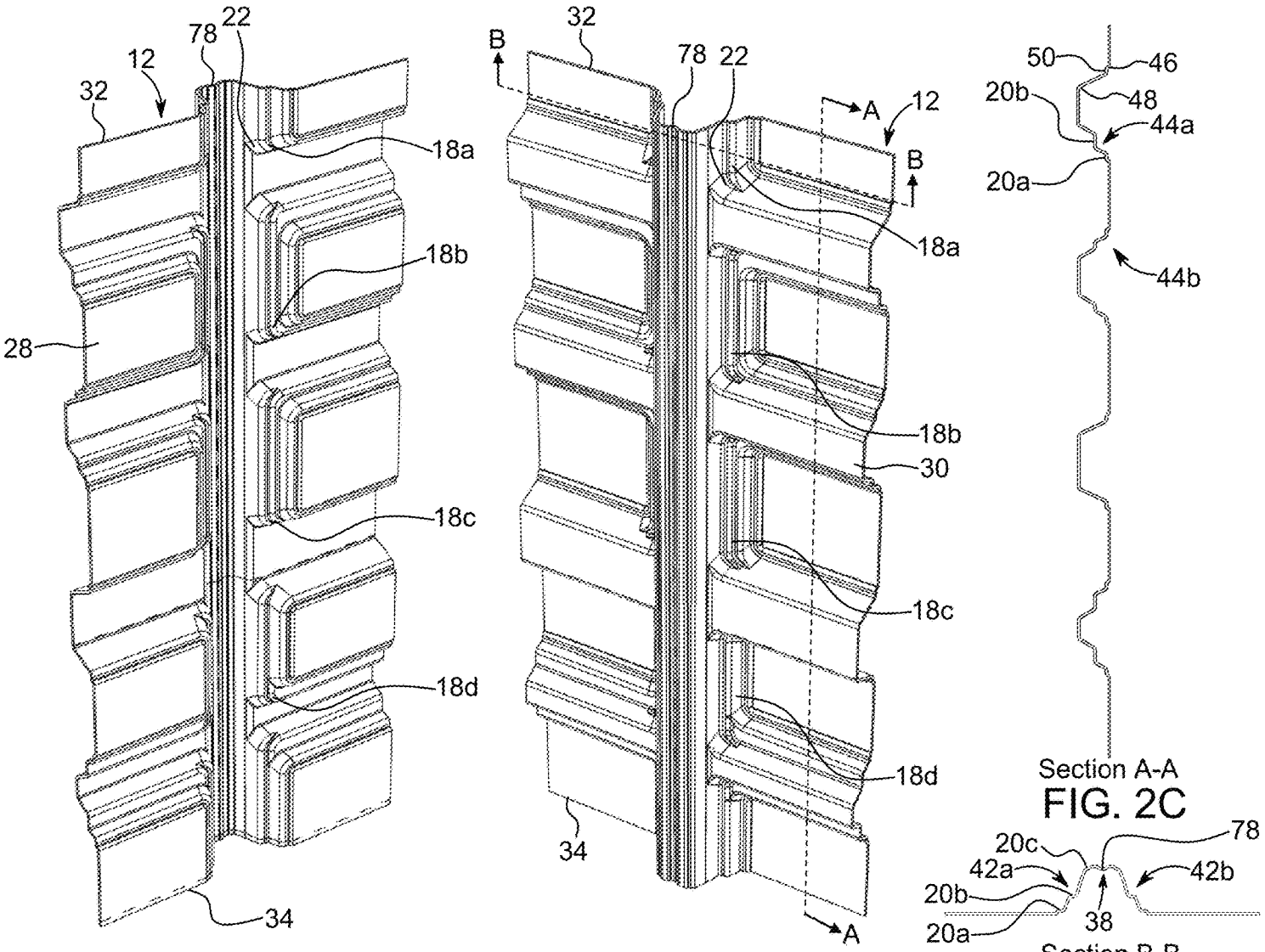
FIGS. 2A and 2B respectively show a front and back perspective view of a wall panel having multiple ledges within some of the channel sidewalls according to another embodiment of the invention described herein.
FIGS. 2C and 2D respectively show side and top section views of a portion of the wall panel shown in FIGS. 2A and 2B.

The following description of the preferred embodiment(s) is merely exemplary in nature and is in no way intended to limit the invention, its application, or uses.

FIGS. 1A-1D, 1E-1H, and 1I-1L show exemplary embodiments of wall panels particularly designed for electrical installations for a wall system 10 according to the present invention and FIGS. 17A-17K show additional alternative electrical panel embodiments. Similarly, FIGS. 2A-2D show an exemplary embodiment of a wall panel 12 particularly designed for plumbing installations for a wall system 10 according to the present invention while FIGS. 16A-16H show alternative plumbing panel embodiments. Regardless of the particular construction, the innovative corrugated panel includes a longitudinal channel 14 extending the panel height between the top end 32 and bottom end 34 of the panel 12 and multiple lateral channels 16*a*, 16*b*, 16*c*, 16*d* (collectively referred to as lateral channels 16) extending the panel width between the opposing side ends 36*a*, 36*b* of the panel 12. The panel 12 has a front face 28 and a back face 30 that are spaced from each other by the panel total thickness. The panels 12 are preferably formed from a thin-walled material with a material thickness so the channels that are recessed from the front face 28 appear as projections on the back face 30. In these exemplary embodiments, the material thickness of each of the panels 12 are approximately ⅜" while the total thickness of the panel 12 shown in FIG. 1A-1D is either 2" or 2½" and is 3" for the panels 12 shown in FIGS. 1E-1H and 1I-1L. It will be appreciated that the panels 12 could be formed from a material that is thicker than the depth of the channels so that the channels are recessed from the front face 28 but has a flat back surface. There could be other constant thicknesses for the material thickness that could be thinner than ⅜" (such as if metal, plastic, or composite sheets are used for the panel's material) or significantly greater than ⅜", and as explained in more detail below, the material thickness may also change in different locations of the panel 12.

Figure 15A:
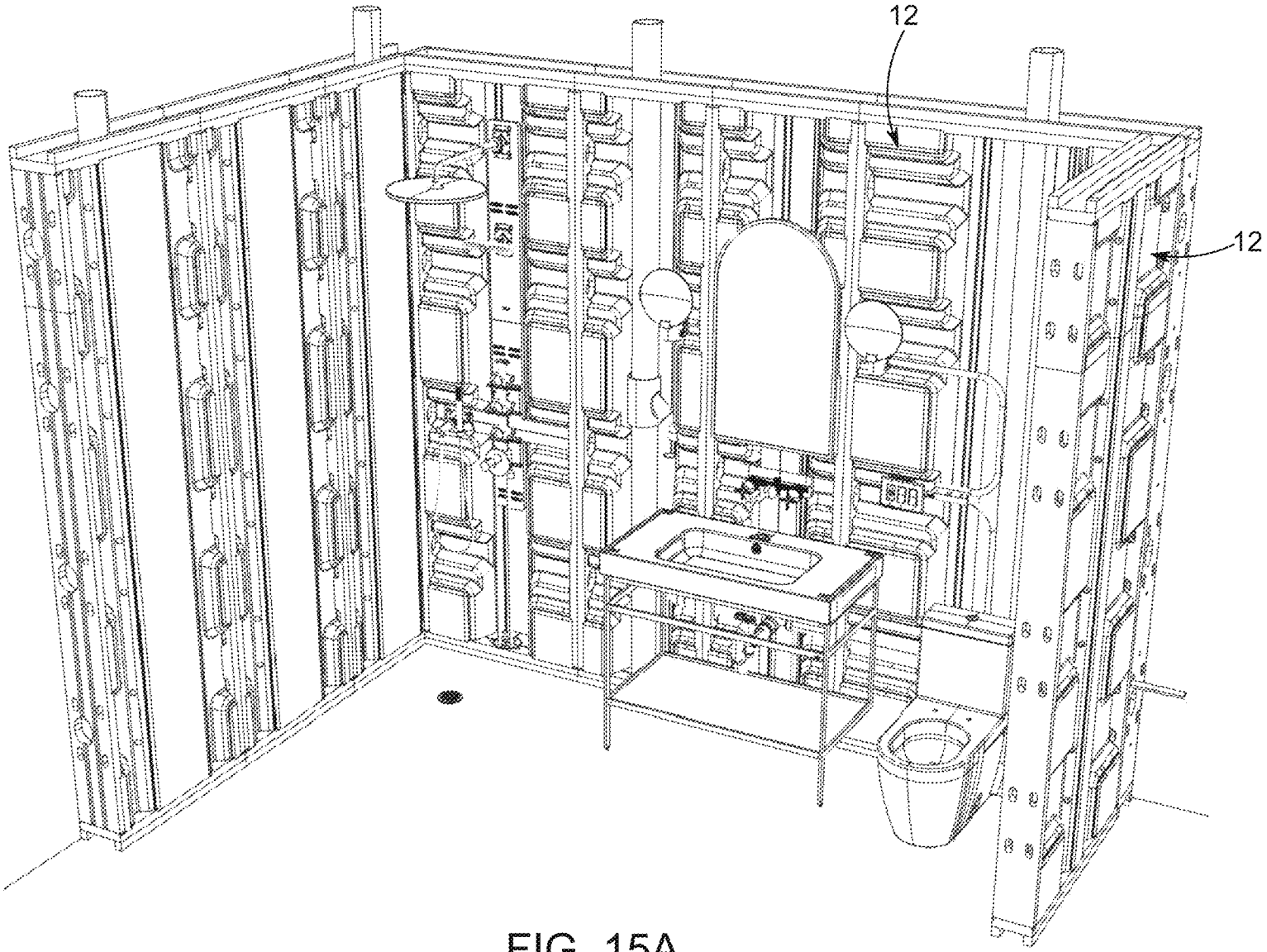
FIG. 15A shows a perspective view of a completed wall system installation according to embodiments of the invention described herein.

The preferred embodiments of the wall panels 12 described herein include series of lateral channels 16 for horizontal installation and at least one longitudinal channel 14 for vertical installation of conduits and components for electrical, plumbing, central vacuum, and HVAC systems. FIG. 15A shows an example of a bathroom installation. Electrical conduits include power lines, communication wires (such as cables for audio/video systems, telephony, internet, etc.). Plumbing conduits include pipes for fresh water and waste water and vent lines. Tubes for central vacuum systems and ducts for HVAC system can also be run through the structural panel assemblies, although these conduits and the main waste water and main vent pipes are much more likely to run in the longitudinal channels 14 rather than in the lateral channels 16. Lateral channels 16 are mainly for routing smaller diameter waste water and corresponding vent lines to the respective main waste lines, which are located in the longitudinal channels. Electrical components could include j-boxes, wall sconces, switches, outlets and the like. Similarly, plumbing components could also include corner stop vales, manual or electronic thermostats, shower control valves, wall mounted shower heads or wall mounted faucets, fresh water outlets and waste water inlets such as drains and p-traps, and utility points for washers and dryers and refrigerators at varying heights depending on the particular need according to the building design. Of course, there could be any number of lateral or longitudinal channels.

Figure 3A:
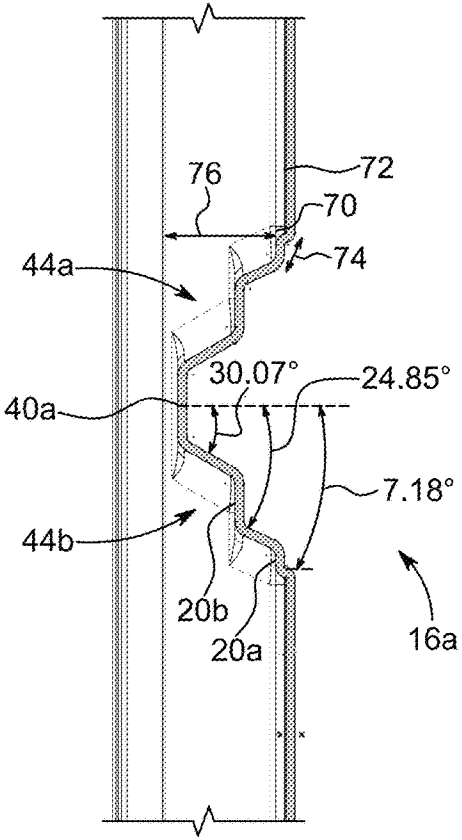
FIGS. 3A and 3B respectively show detail cross-sectional views of the lateral channel and the longitudinal channel with multiple ledges.
Figure 3B:
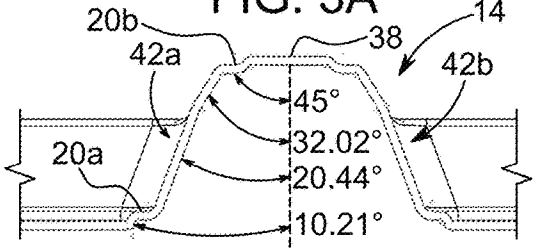

FIGS. 3A and 3B respectively show cross-sectional views of embodiments of the lateral channel 16 (e.g., lateral channel 16*a*) and the longitudinal channel 14. The channels 14, 16 are respectively recessed a longitudinal channel depth and a lateral channel depth from the front face 28 of the panel. Although the depths of the channels 14, 16 can vary based on intended use, the lateral channel depth is less than the longitudinal channel depth in the preferred embodiment. For the panel 12 shown in FIGS. 1A-1D, the lateral channel depth is either 1½" or 2⅛" while the total lateral channel depth is 2⅝" for the panels 12 shown in FIGS. 1E-1H and 1I-1L. These channel depths, along with the steps 20*a*, 20*b*, 20*c* (collectively referred as steps 20) described in detail below with regard to the panels 12 shown in FIGS. 1E-1H and 1I-1L, accommodate standard j-boxes which have a front-to-back size of 2⅛". As particularly shown in FIGS. 3A and 3B, the angles of the sidewalls 42*a*, 42*b*, 44*a*, 44*b* for the longitudinal and lateral channels 14, 16 preferably become more shallow from the front face 28 to the trough 38, 40*a*, 40*b*, 40*c*, 40*d* of the respective channels, i.e., the acute angle relative to the plane perpendicular to the trough 38, 40*a*, 40*b*, 40*c*, 40*d* increases from the front face to the trough. In particular, for the lateral channel cross-section shown in FIG. 3A, the sidewall 44*a*, 44*b* to the first step 20*a* is approximately seven degrees (7°) and the sidewall 44*a*, 44*b* to the second step 20*b* is approximately twenty-five degrees (25°), and the sidewall 44*a*, 44*b* extending down to the deepest trough 40*a* in the lateral channel 16*a* is thirty degrees (30°). Similarly, for the longitudinal channel cross-section shown in FIG. 3B, the sidewall 42*a*, 42*b* to the first step 20*a* is approximately ten degrees (10°) and the next deeper sidewall 20*b* has a shallow section that is approximately twenty degrees (20°) and a deeper section that is approximately thirty-two degrees (32°), and the sidewall 20*c* extending down to the deepest trough 38 in the longitudinal channel 14 is forty-five degrees (45°).

Each channel 14, 16 has opposing sidewalls 42*a*, 42*b*, 44*a*, 44*b* and that span the corresponding channel depth between proximal ends connected to the front face 28 and distal ends connected to a channel trough 38, 40*a*, 40*b*, 40*c*, 40*d*. The sidewalls 42*a*, 42*b*, 44*a*, 44*b* are preferably sloping between the proximal and distal ends to allow for identically shaped corrugated panels to be stored and transported in tightly packed stacks and to be individually removed from the stack without the panels 12 binding to each other. However, the sidewalls 42*a*, 42*b*, 44*a*, 44*b* could be perpendicular to the front face 28 without departing from the inventive aspects of the invention described herein. The longitudinal and lateral channels 14, 16 within each panel 12 allow for easy installation of and the conduits and components for electrical, plumbing, HVAC systems, central vacuum, insulation and other utilities without the need for threading as with previously designed systems.

In addition to lateral and longitudinal channels 14, 16 on the front of the panel 12, an alternative embodiment may also have a rear channel on the back of the panel 12. As particularly shown in FIGS. 2B and 2D, the rear longitudinal channel 78 is recessed from the back face 30 within the trough 38 of the longitudinal channel 14 and spans the panel height between the top end 32 and the bottom end 36. For embodiments with multiple longitudinal channels, the rear longitudinal channels 78 can be provided in one or more of the longitudinal channels 14 and could also be provided within the lateral channels 16 as described below with reference to FIGS. 1I-IL.

Generally, the channels 14, 16 of the present invention enable installation without the need for complex threading, looping, lacing or time consuming measures. Adjacent wall panel assemblies have channels at the same location relative to panels side, top and bottom edges so that the conduits can run the entire length or height of the wall if needed. The lower lateral channel 16 is proximate to the bottom edge 34, with the pair of middle lateral channels being proximate to the center of the corrugated panel, and the upper lateral channel is above the center of the corrugated panel. The lateral channel 16 is preferably centered on the wall panel 12.

With the lateral and longitudinal channels 14, 16 spanning the width and height of the panel 12, the channels 14, 16 intersect at channel transitions 18*a*, 18*b*, 18*c*, 18*d* (collectively referred as channel transitions 18) across the front and back face 28, 30 of the panel 12. In all embodiments, the channel transitions 18 and other transitions discussed below have curved sections with a radius of curvature 22, devoid of a right angle with a shear sharp corner. Proximal and distal sidewall transitions 46, 48 also have curved sections with a radius of curvatures rather than a shear sharp corner. As detailed below, the radius of curvature may vary relative to the position of the transitions on the panel 12, particularly for the channel transitions, but each curved section has a curve:thickness ratio between the radius of curvature and the panel material thickness that ranges between 0.5:1 and 20:1 and is preferably approximately 5:1. Preferably, at least one channel sidewall has a flat region; accordingly, the radius of curvature is limited based on the distance between parallel channels. Furthermore, steps 20 within the sidewalls 42*a*, 42*b*, 44*a*, 44*b* of the channels 14, 16, discussed below, also have curved step transitions 50. Instead of shear, sharp corners, a curved corner section is an inventive concept that allows mass production of corrugated panels that is not otherwise feasible if transition sections were to include sharp corners. The preferred corrugated panel is made from wood strands or long plant fibers and pressed into the intended panel shape wherein transitions with sharp corners are undesirable because of the shearing that would occur during the manufacturing process.

The preferred corrugated panel is made from wood strands made from small diameter timber or other suitable materials. To achieve the desired structural performance, the length and integrity of the wood strands in three dimensional forming the corrugated panel is vital. Adequately curved surface transitions 18, 46, 48, 50 between surfaces prevent the wood strands from breaking during the deep three dimensional deformation process. Of primary importance, if the channel transitions 18 between the lateral and longitudinal channels 14, 16, especially in the region around the panel front faces 28, have sharp corners or sharp-edged surface transitions, the lignum fibers inside the wood strands or any other suitable biobased strand like material, could either be weakened, tear or break, rending the strands unsuitable to become a corrugated panel of satisfactory quality. To provide a structurally viable panel, the integrity of the wood strands after forming are of vital importance to produce a panel of consistent density. Specifically, the intersections between the front face 28 of the panel 12 and the perpendicular intersections between the lateral and longitudinal channels 14, 16, i.e., particularly in the corner regions at the channel transitions 18, create stress points during the three dimensional (3D) compression molding process as the strand matt, which is made of various layers of loose wooden stands, tends to separate, causing shear thinning at these corner points, resulting in inconsistent density and unsuitable quality. To avoid these quality issues, it is beneficial for all surface transitions 18, 46, 48, 50 to include adequate curvatures or radii to reduce this effect. It will be appreciated that the radius of curvature can be approximated by one or more facets between the surface transitions 18, 46, 48, 50.

The panel 12 described herein also improves over prior art panels by providing curvatures at surface transitions that are measurably larger the further the transition is spaced away from the front face 28 of the corrugated panel 12 which overcomes several issues, such as shear thinning of the strand mat, which would occur at sharp corner transitions. The panel 12 is devoid of shear sharp corners as mentioned above, and the group of channel transitions 18 between the longitudinal and lateral channels 14, 16 are also sized to increase relative to the proximity to the back face 30 of the panel 12. The group of proximal channel transitions 18' within a plane that is closest to the front face 28 of the panel 12 have a radius of curvature that is less than the group of distal channel transitions 18" within a plane that is closest to the back face 30. Furthermore, middle channel transitions 18''' within a middle plane between the proximal and distal plane have a radius of curvature that is between the proximal channel transitions 46 and the distal channel transitions 48. Accordingly, as shown in detail in FIGS. 4A-4C, the curvature widens for the channel transitions that are deeper in the channels 14, 16, i.e., approaching the back face 30 of the panel 12, so the curvature of radius of the sidewall transitions are greater than the radii of the front face 28 to the first step 20*a*, and the sidewall transitions between the first step 20*a* and the bottom of the trough 38, 40*a*-40*d* are greater and either have a constant curvature or an increasingly widening curvature.

Figure 15C:
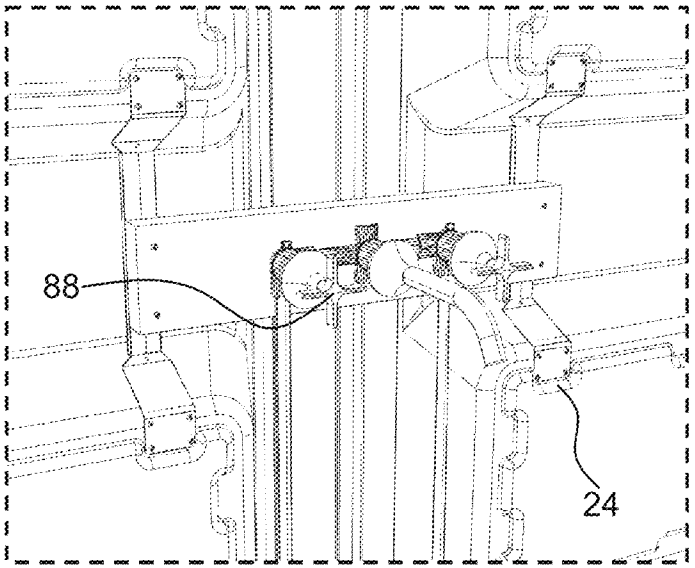
FIGS. 15B-15H show detail views of utility installations within a wall panel according to embodiments of the invention described herein
Figure 15E:
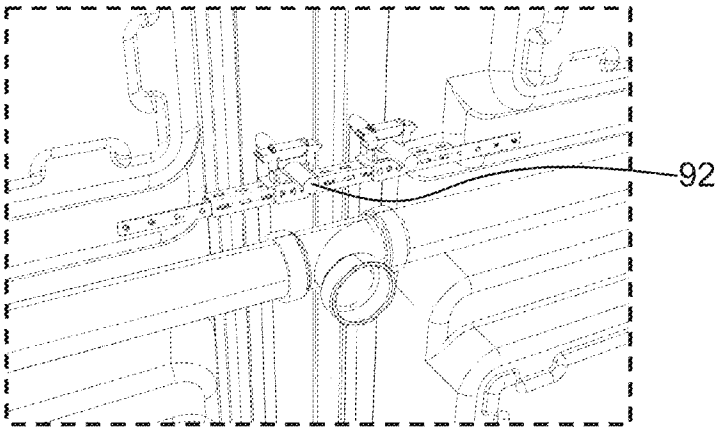
Figure 15B:
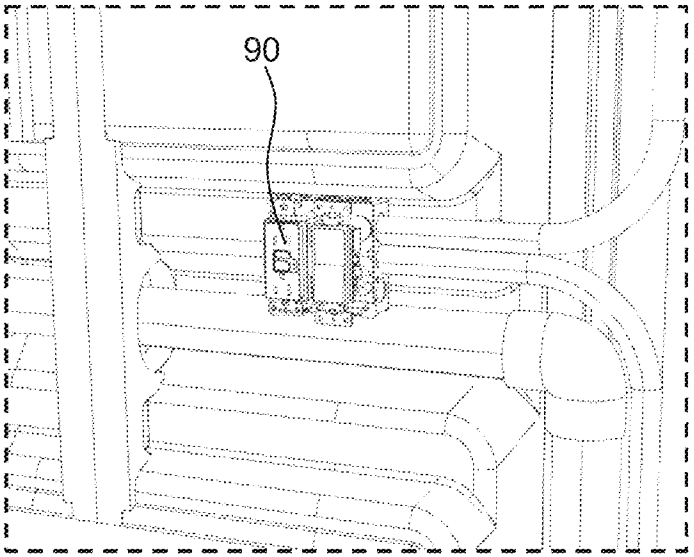
Figure 15D:
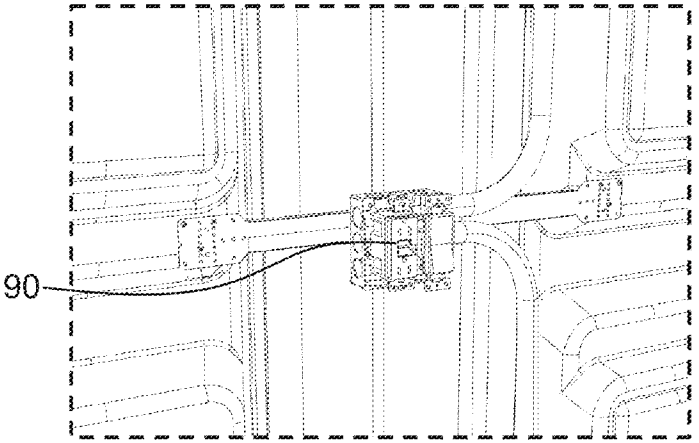
Figure 15G:
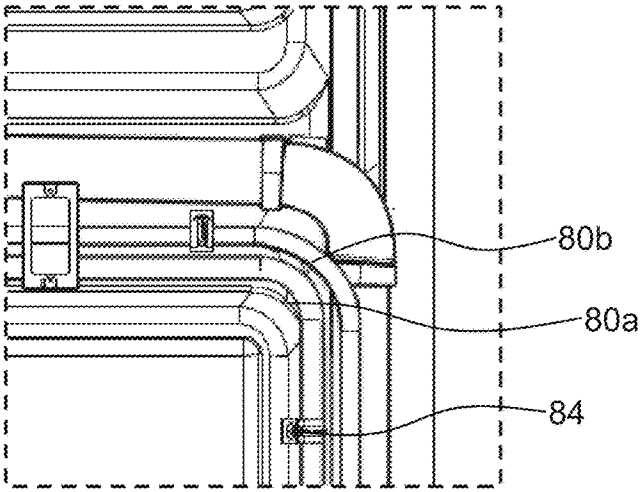
Figure 15H:
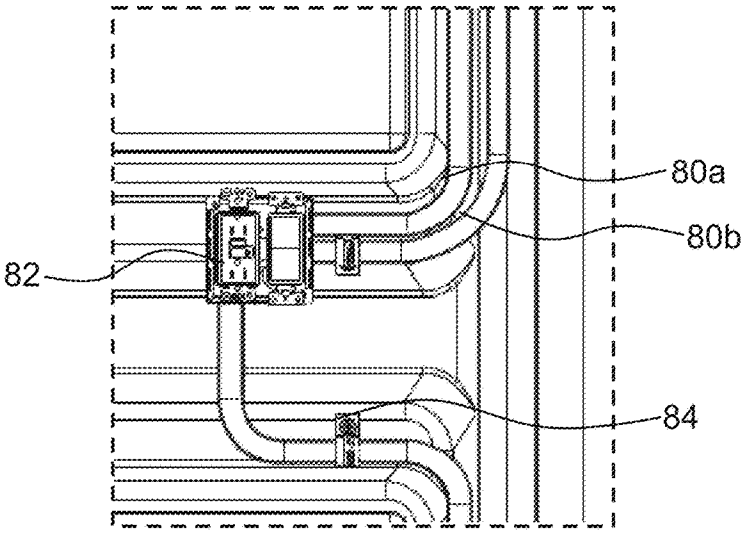
Figure 15F:
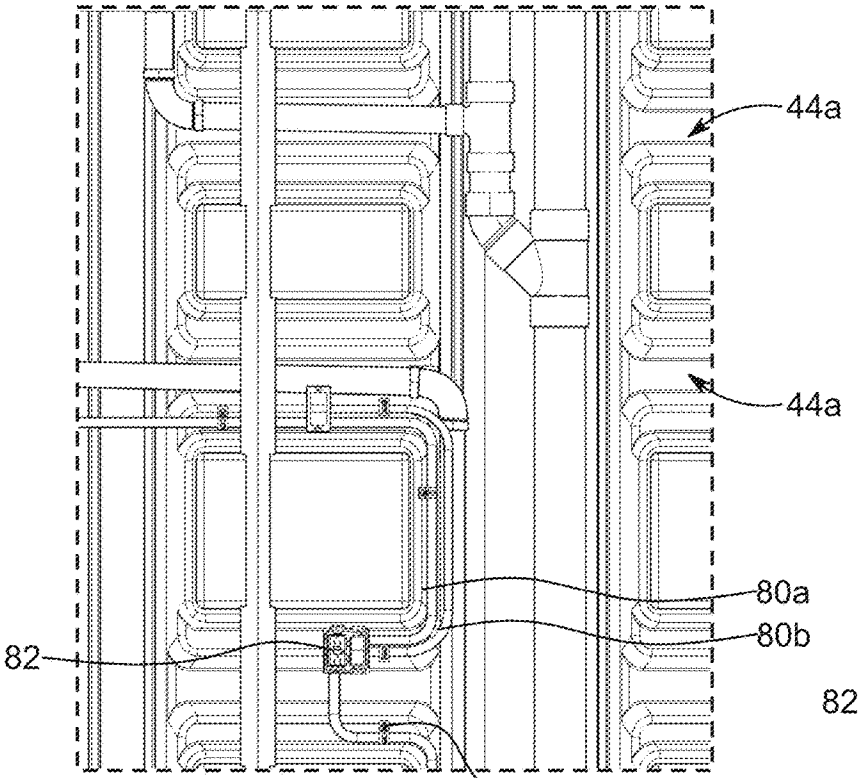
Figure 17A:
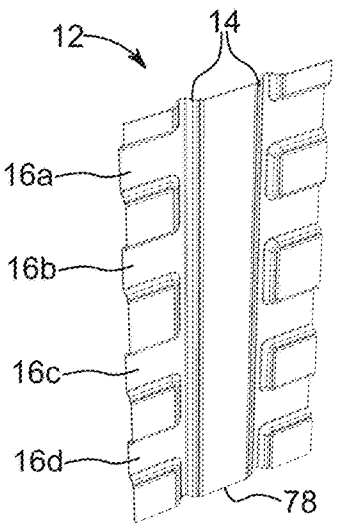
FIGS. 17A-17K show front perspective views of wall panels having alternative channel configurations for electrical installations according to embodiments of the invention described herein.
Figure 17B:
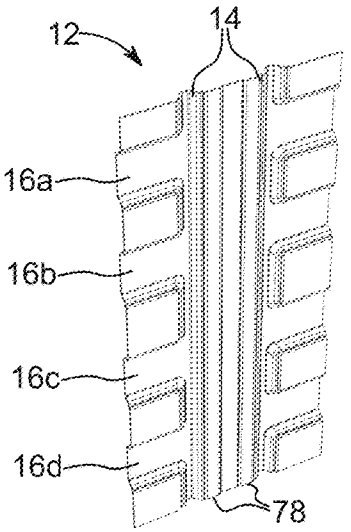
Figure 17C:
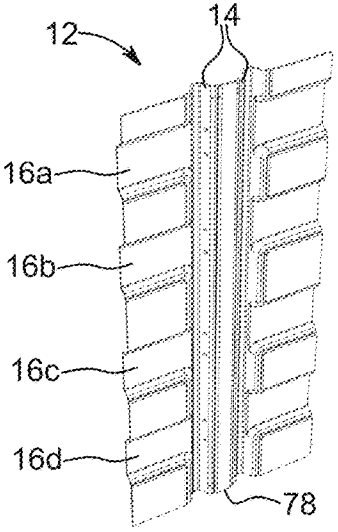
Figure 17D:
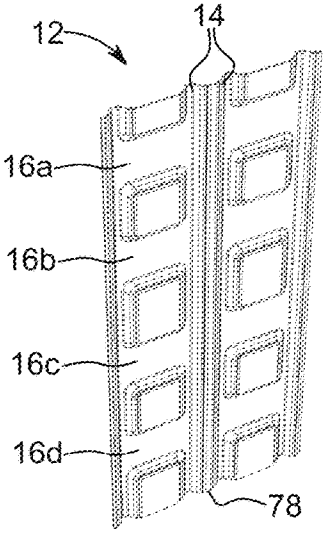
Figure 17E:
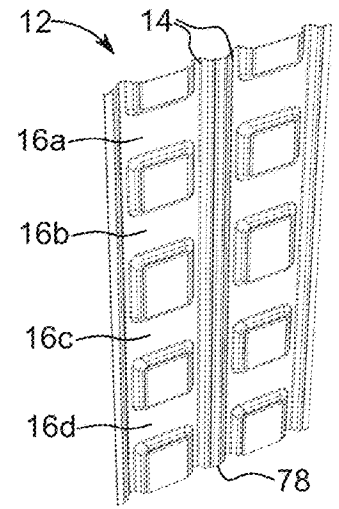
Figure 17F:
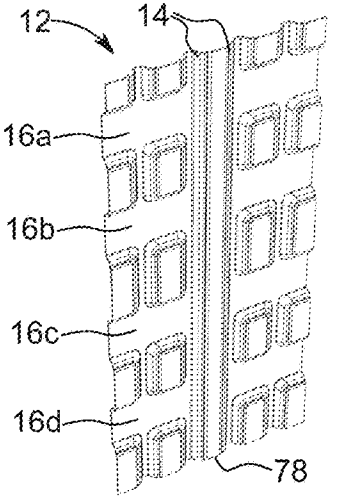
Figure 17G:
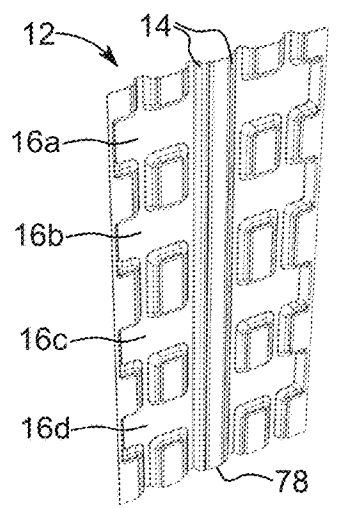
Figure 17H:
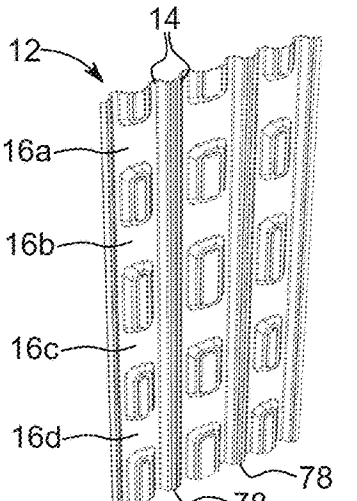
Figure 17K:
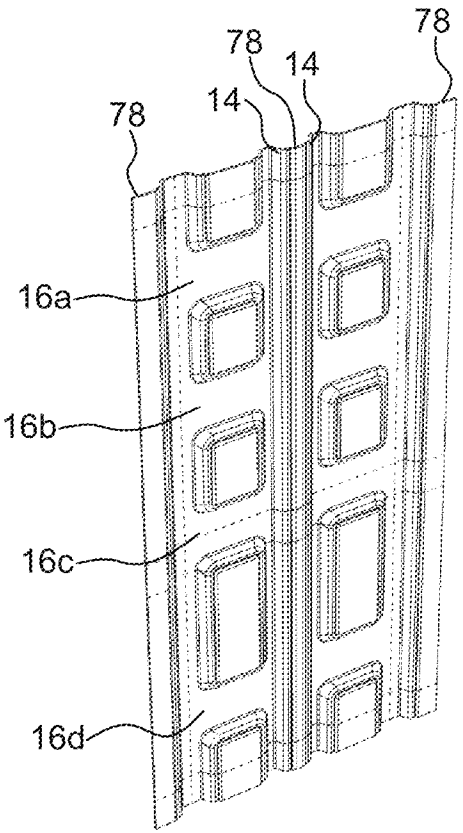
Figure 17J:
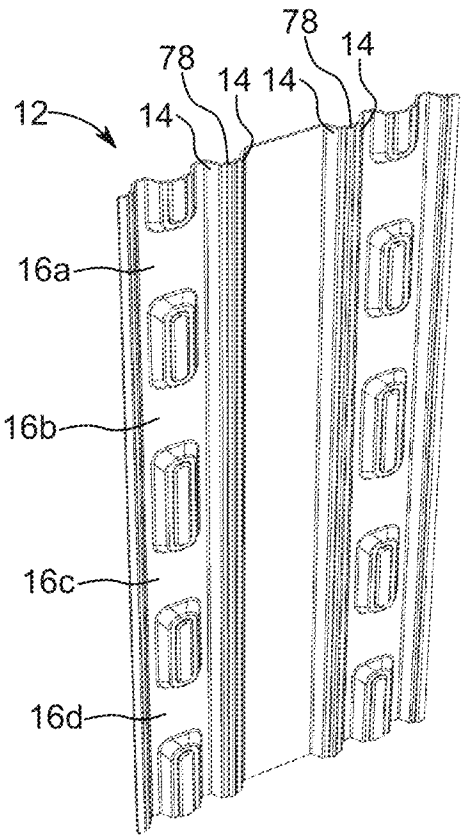
Figure 17I:
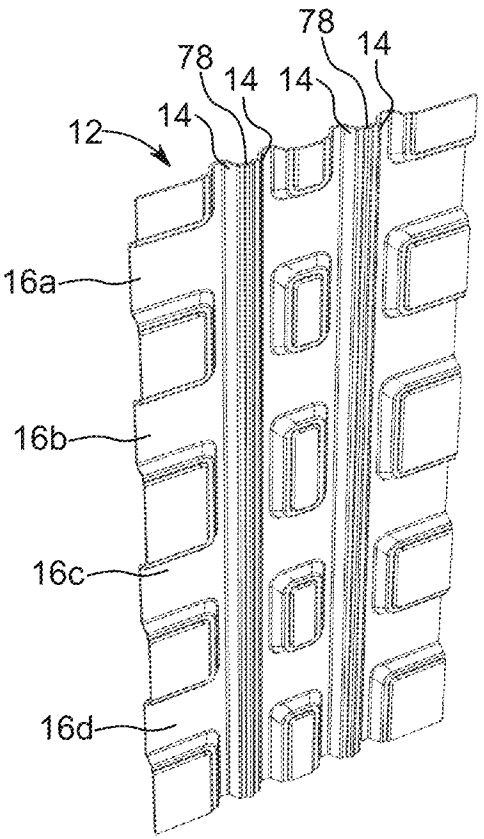

As shown in FIGS. 15F-15H, these larger curvatures provide needed transition space to accommodate both the geometries of curved plumbing fittings and curved electrical elbows, to be able to locate these objects close to the sidewalls 42*a*, 42*b*, 44*a*, 44*b* for strapping and therefore provide sufficient installation space for various pipes to run parallel in one channel. Each channel transition 18 on the panel 12 includes a curved section that is devoid of a sharp ninety degree (90°) corner. Although these channel transitions 18 may affect a ninety degree (90°) bend between the adjoining segments, the curved section allows for a rounded and smooth transition rather than a sharp ninety degree (90°) corner that is created when the ends of two segments meet perpendicular to one another. As shown in FIG. 15F, the curved surface transitions between the longitudinal and lateral channels 14, 16 allow two electrical conduits 80*a*, 80*b* to run close to the sidewalls and connect to a J-box 82, which is mounted to the second step 20*b*, while allowing a waste water pipe assembly, run without interference behind the electrical installation, allowing for complex installations of different components in a tight space. In addition, FIG. 15H shows a J-box 82 which mounted to the upper second step in the lateral channel, with electrical conduit 80*a*, 80*b* running both horizontally and vertically along the sidewall of the channels, with various bending radii to allow for a space saving installation. Furthermore, it shows how the electrical conduits 80*a*, 80*b* are secured against the second step with straps 84.

In each of the embodiments shown in FIGS. 1E-1H and 1I-1L, the lateral channel's second step (closest to the trough 40*a*-40*d*) is preferably half an inch (½") from the bottom of the trough 40*a*-40*d*. Since the lateral channels 16 of these panels 12 have a total depth of 2"⅝", a j-box 82 can be secured to the face of the second step and there is a half inch (½") space between the backside of the j-box 82 and the trough 40*a*-40*d* of the lateral channel 16. This half inch (½") space provides sufficient room for a cable run in which cables and other wires can be laid at the bottom of the trough 40*a*-40*d* and behind the backside of the j-box 82. In the embodiment shown in FIGS. 1I-1L, there is also a rear lateral channel that is recessed a depth from the panel's back face and which forms a middle island 86 on the front side of the panel within the lateral trough between the second step on either side of the lateral channel 16. The j-box 82 can straddle the middle island 86. This island 86 also may actually extend all the way to and intersect with the longitudinal channel 14 and provides an increased surface area for adhering sandwiched panels together.

In an alternative embodiment not shown in the drawings, channel transitions 18 devoid of a sharp ninety degree (90°) corner can be achieved with faceted sections rather than a smooth curve at each channel transition 18 between the channels themselves, the proximal ends of the sidewalls 42*a*, 42*b*, 44*a*, 44*b* and the front face 28 of the panel 12 and the distal ends of each sidewall 42*a*, 42*b*, 44*a*, 44*b* and the corresponding troughs 38, 40*a*-40*d*. In this embodiment, each sidewall 42*a*, 42*b*, 44*a*, 44*b* can include multiple faceted sections slightly angled relative to one another to collectively define the smooth channel transition without any sharp corner. The particular number of faceted sections is not intended to be limiting and will depend on the relative angle between the various facets and the overall size of the transition.

Figure 18:
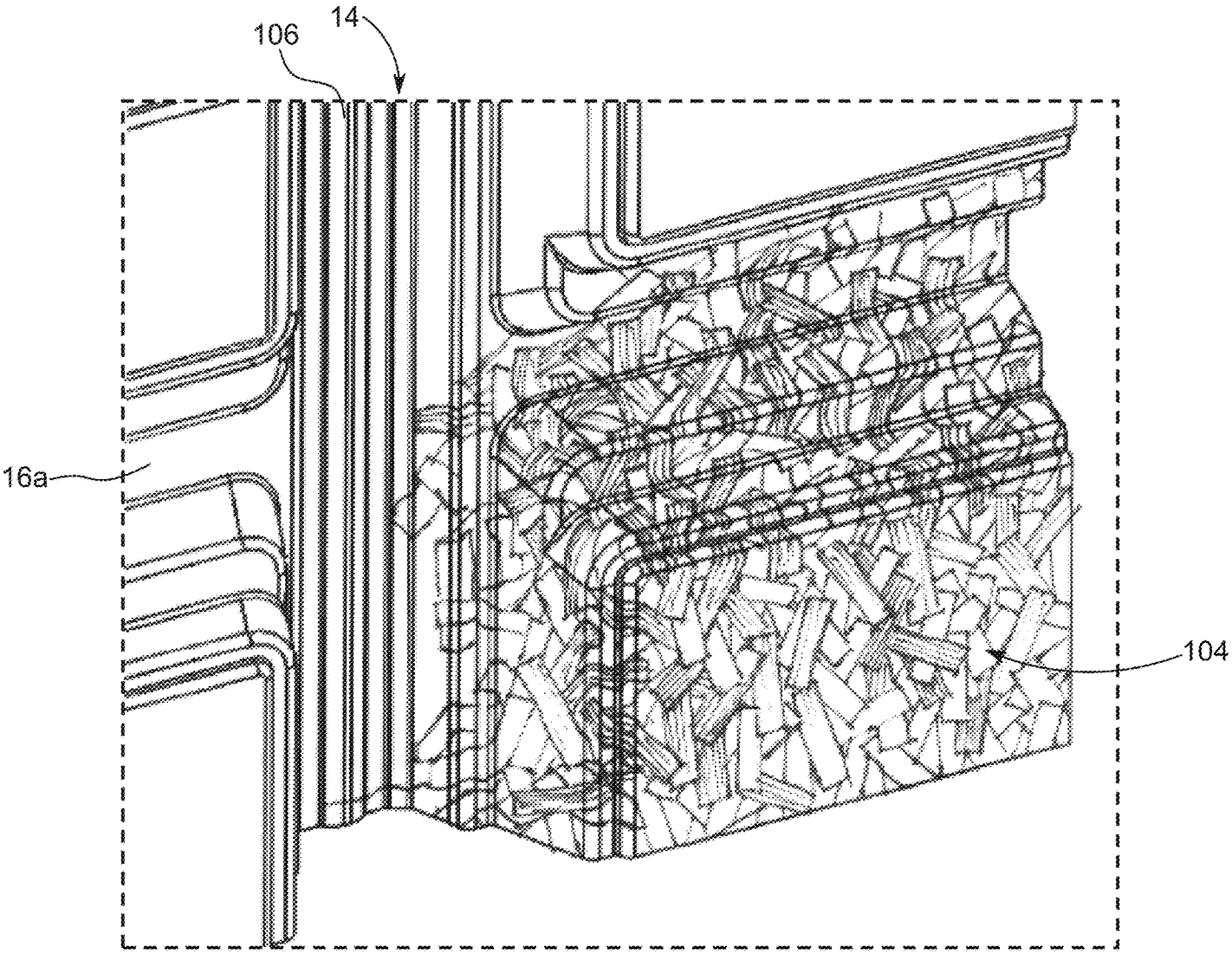
FIG. 18 illustrates the preferred wood strand material used to form wood panels in the preferred embodiment according to the invention described herein.

As shown in FIG. 18, a specific orientation of each strand layer 104, where the majority of strands is predominately oriented lengthwise in the longitudinal direction, will provide sufficient structural performance capacity. The outer most layers show greater variation in a crisscross pattern where the strands are somewhat randomly oriented at an angles less than ninety degrees (90°) lengthwise towards each other, with a general overall lengthwise direction following the longitudinal direction. The inner layers, closer to the core of the corrugated panel would be facing predominantly in the longitudinal direction, whereas the core layers would be mostly crisscross at an angle less than forty five degrees (45°), with their general directionality being longitudinal. The curved transitions between changing surface directions, in combination with this kind of layering of wood strands minimizes shear thinning, strand breakage and separation in the critical areas, but allows for the loose strand mat to evenly form around the curved surface transitions, providing a panel of consistent density and therefor satisfactory structural integrity though out.

In a primary aspect of the inventive wall panel 12 described herein according to the preferred embodiment, each sidewall 42*a*, 42*b*, 44*a*, 44*b* of each channel 14, 16 includes at least one step proximate to the front face 28. FIGS. 1C and 1D respectively show a cross-section views of the lateral and longitudinal channels 14, 16 with a first step 20*a* within each sidewall 42*a*, 42*b*, 44*a*, 44*b* of each of the channels 14, 16. The first step 20*a* is recessed a first step depth from the front face 28 which in all embodiments is less than half (½) the overall depth of the channel 14, 16 in which the step is positioned. In the preferred embodiment with a thin-walled panel, the first step depth is less than three to five (3-5) times the panel's material thickness.

Figure 4B:
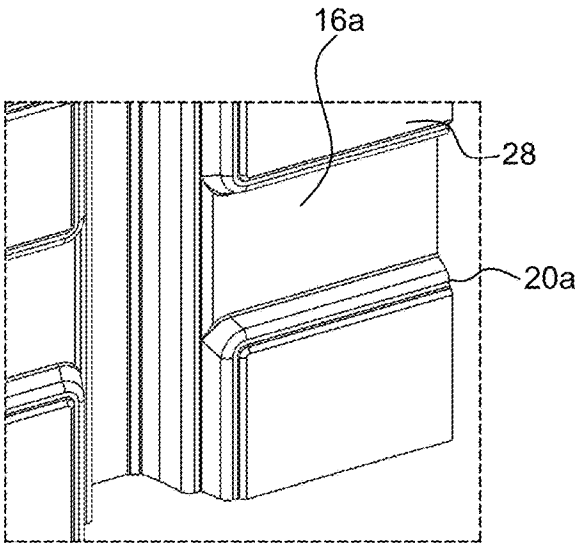
FIGS. 4A-4C are detail perspective views of alternative embodiments of the lateral channel and the longitudinal channel with multiple ledges.
Figure 4A:
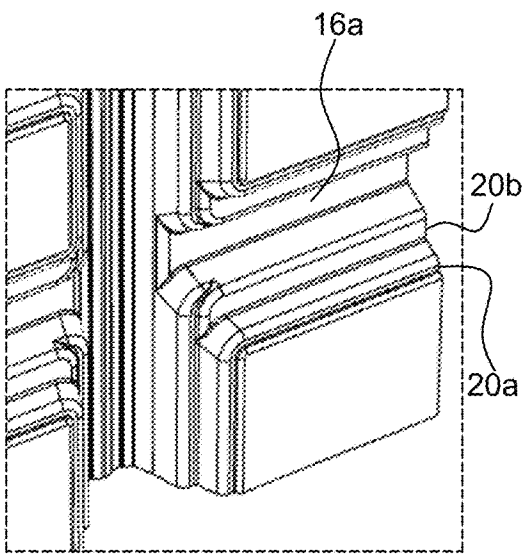
Figure 4C:
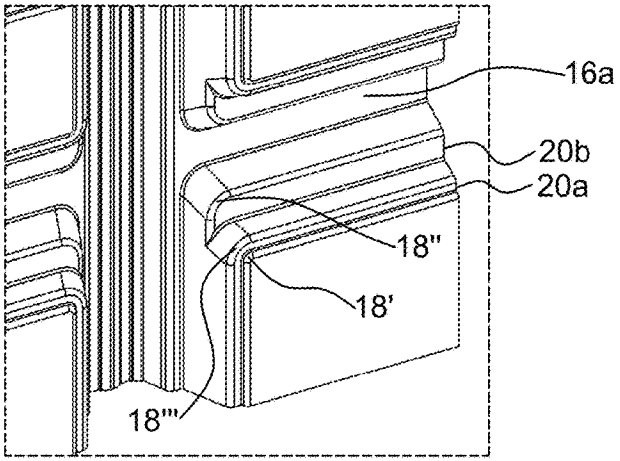

In the alternative embodiment particularly shown in FIGS. 1 and 4, the channels 14, 16 also include a second step 20*b* recessed a second step depth from the front face 28 that is greater than the first step depth. In these embodiments each sidewall 42*a*, 42*b*, 44*a*, 44*b* includes two steps with the second step 20*b* positioned at a location between the first step 20*a* and one of the corresponding longitudinal troughs 38 and lateral troughs 40*a*-40*d*. FIGS. 4A and 4B show embodiments with both the lateral and longitudinal channel 14, 16 having two steps in each sidewall 42*a*, 42*b*, 44*a*, 44*b* with the second steps 20*b* having the same depth in FIG. 4A and differing depths in FIG. 4B. Alternatively, FIG. 4C shows an embodiment with only the lateral channel 16 having a second step 20*b*. Accordingly, some sidewalls of the channels may include only the first step 20*a* while other sidewalls include the first step 20*a* and a second step 20*b* that can be at varying depth depending on need. The step configuration is therefore not intended to be limiting wherein each sidewall includes a first step 20*a* proximate to the front face 28 and optionally includes a second step 20*b* between the first step 20*a* and the corresponding trough 38, 40*a*-40*d*.

Regardless of the step configuration, each step 20 includes an inner edge 70 and an outer edge 72 that are radially spaced by the step width. With the first step 20*a* positioned within each sidewall 42*a*, 42*b*, 44*a*, 44*b*, the sidewalls 42*a*, 42*b*, 44*a*, 44*b* further include a first section 74 between the outer edge 72 of the first step 20*a* and the proximal end of the sidewall and a second section 76 between the inner edge 70 of the first step 20*a* and the distal end of the sidewall (as depicted in FIG. 3A). Given the inner edge 70 and outer edge 72 are offset by the step width, the first section 74 and the second section 76 of the sidewall 42*a*, 42*b*, 44*a*, 44*b* are radially offset. The sidewall sections 74, 76 collectively span the depth of the corresponding channel in which the steps are situated with the first section 74 spanning the first step depth and the second section 76 spanning the second step depth. Furthermore, the second step 20*b* is positioned within the second section 76 in embodiments that have another step between the correspond trough 38, 40*a*-*d* and the first step 20*a* proximate to the front face 28.

As noted above, the preferred channel sidewalls slope from the front face 28 to the trough 38, 40*a*-*d* and it will be appreciated that the sidewall sections 74, 76 therefore slope between their respective ends. Given each channel has at least one step interrupting the sidewall sections 74, 76, the slope of the sections is not necessarily equal wherein the first section 74 could be shallower and the second section 76 steeper or vice versa. Alternatively, the slope of each section 74, 76 could be the same.

The function of the first step 20*a* can accommodate bracing strips 94 as shown in FIG. 5. The second step 20*b*, which is on either one or both opposing sidewalls of a channel, is used as an attachment surface parallel to the front face 28 of the panel 12 and provides a location for the installation of j-boxes 82, wall sconces, electrical switches, electrical, media or telephony outlets, or plumbing hardware such as surface mounted corner stops or other mounting hardware or fixtures, not shown. In a preferred embodiment the second step 20*b* is at least twice as wide as the first step 20*a* and provides a solid surface for the j-box 82 to rest on. Standard j-boxes can be located at the ideal code compliant height by pushing the j-box 82 against the transition point between the flat front face of the second step 20*b* and the adjacent sloped side of the channel 14, 16. Standard j-boxes provide a flat back side with various apertures so the j-box 82 can be screwed directly into the step's front facing surface, parallel to the front face 28 of the panel 12. By pushing the j-box 82 against the transition between the flat surface and the sloped side assures that the j-box 82 is not only set at the correct height and depth but also assures a straight, level and plumb placement of the j-box 82, which allows for faster electrical installation and assures the consecutive trades can work seamlessly around the j-box 82. The second step 20*b* also serves as an attachment surface for standard brackets as used for electrical and plumbing installations, which allows the trades to span an open channel to place either a plumbing fixture like a wall mounted faucet 88 as shown in FIG. 15C, an electrical switch box 90 as shown in FIG. 15D, or fresh water lines 92 for a faucet as shown in FIG. 15E between two opposing second steps, both in the lateral channel 16 as well as the longitudinal channel 14 as illustrated in FIG. 15C-15E.

Figures 5A, 5B, 5C:
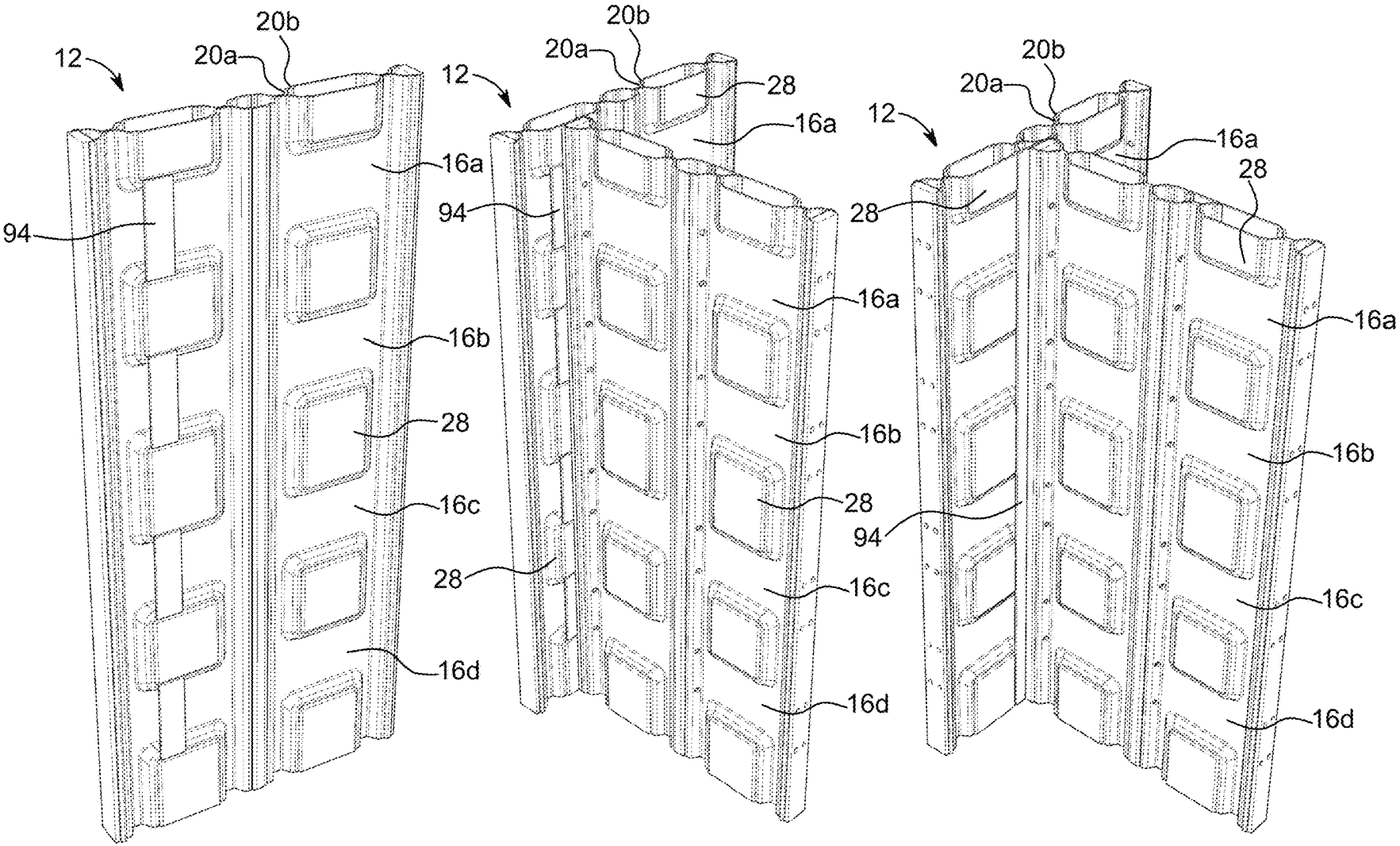
FIGS. 5A-5E illustrate bracing strips within a wall module according to an embodiment of the invention described herein.
Figure 5E:
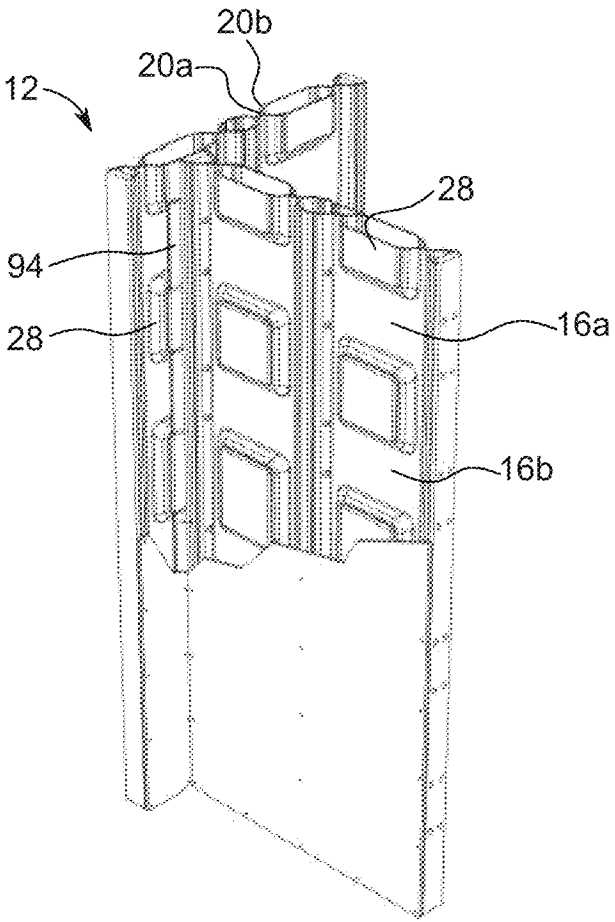
Figure 5D:
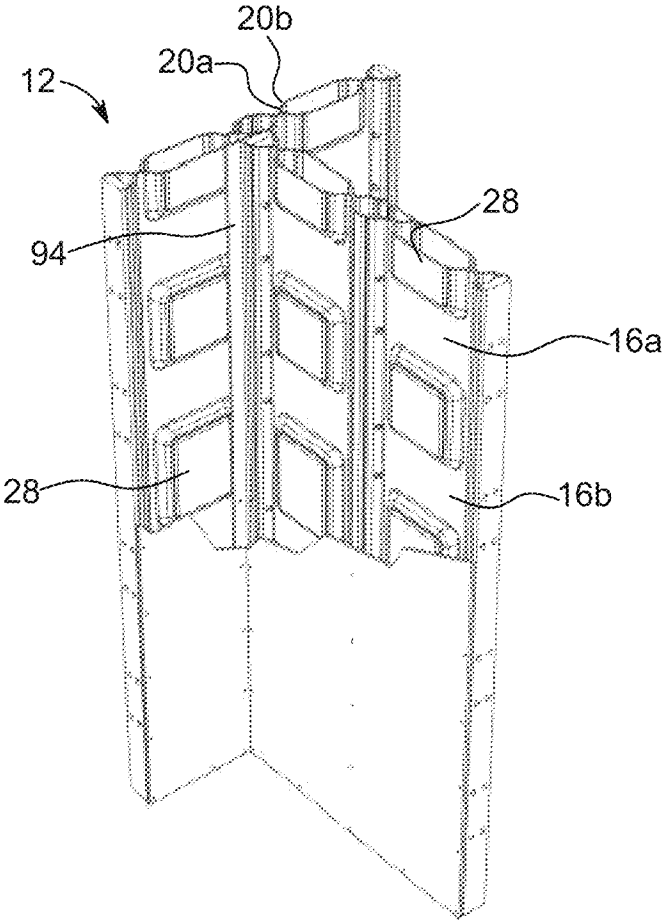
Figure 6C:
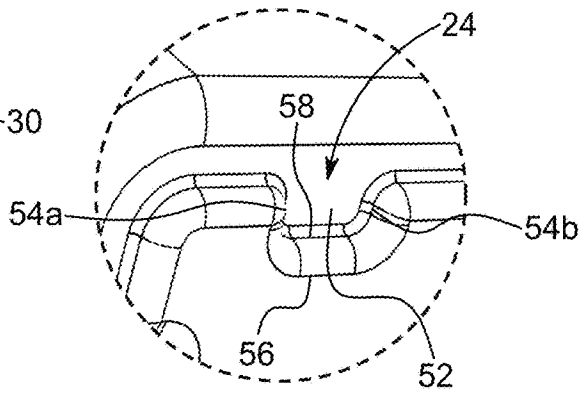
FIGS. 6C and 6D respectively show a detail view and a top section view of indents in the wall panel shown in FIGS. 6A and 6B.
Figure 6D:
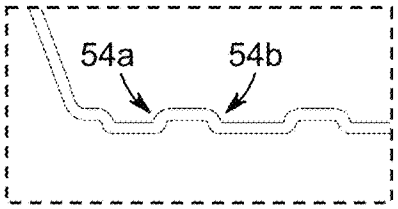
Figure 6B:
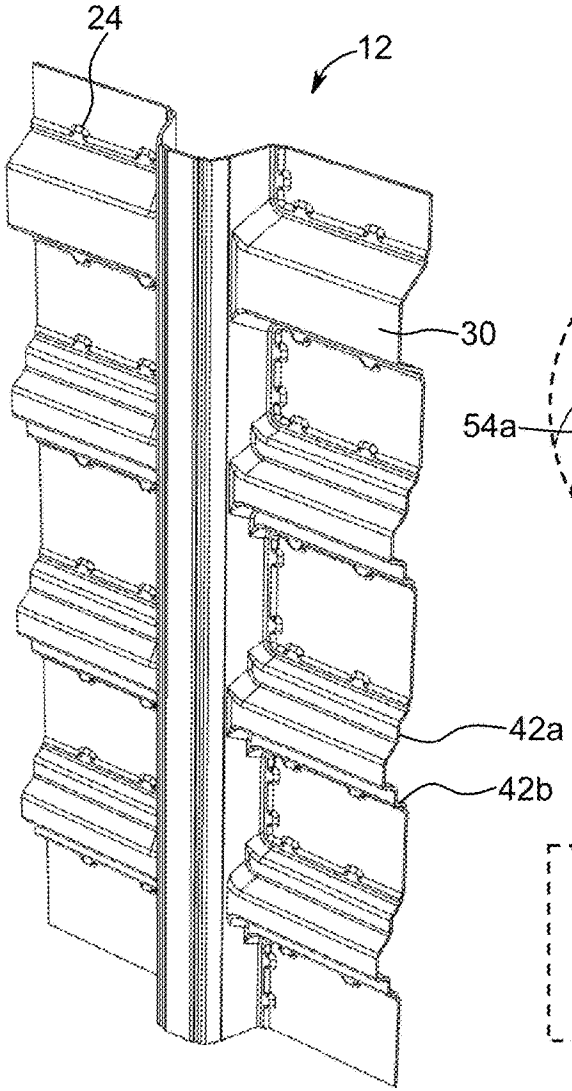
FIGS. 6A and 6B respectively show a front and back perspective view of a wall panel having indents within the lateral channels according to another embodiment of the invention described herein.
Figure 6A:
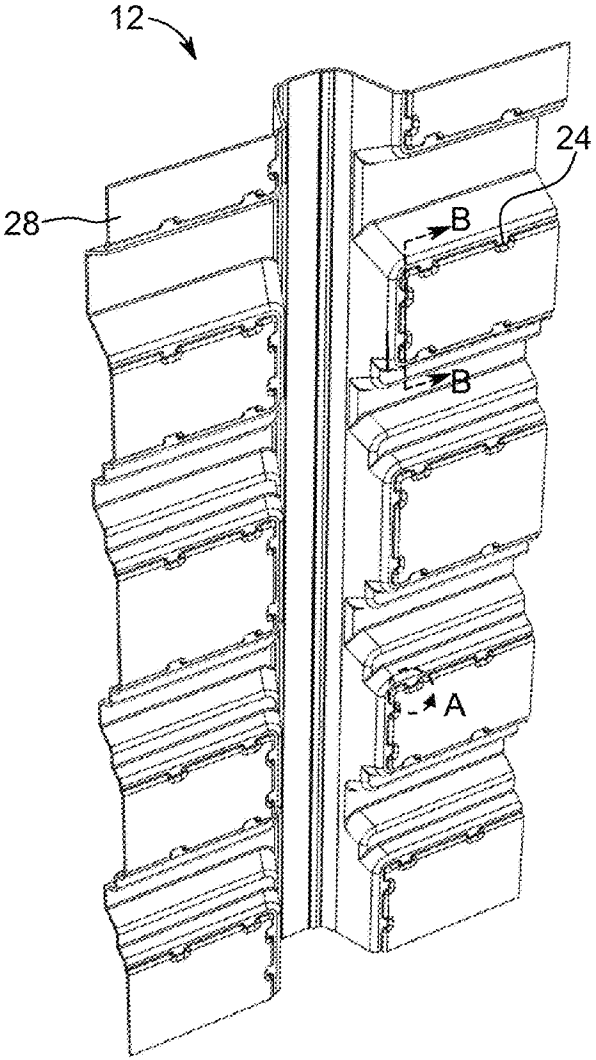
Figure 6G:
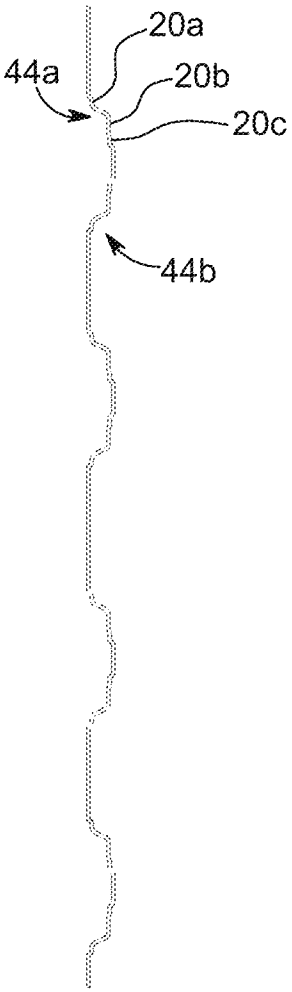
FIGS. 6E and 6G respectively show a front perspective view and a side view of a wall panel having indents within the lateral channels according to another embodiment of the invention described herein.
Figure 6F:
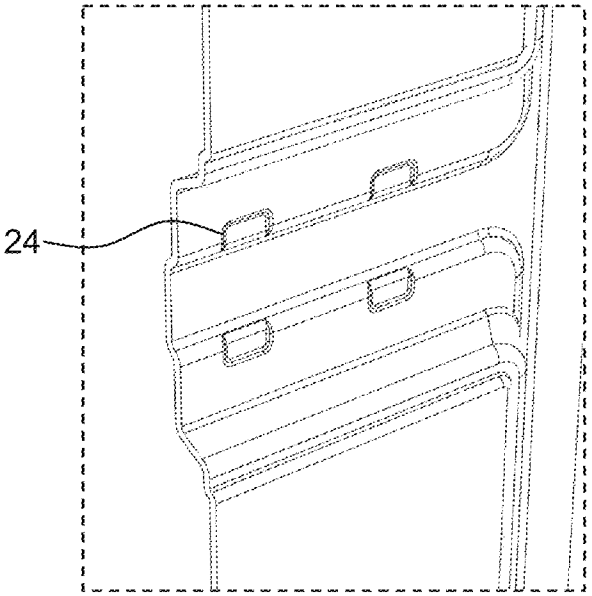
FIG. 6F shows a detail view of indents in the wall panel shown in FIG. 6E.
Figure 6E:
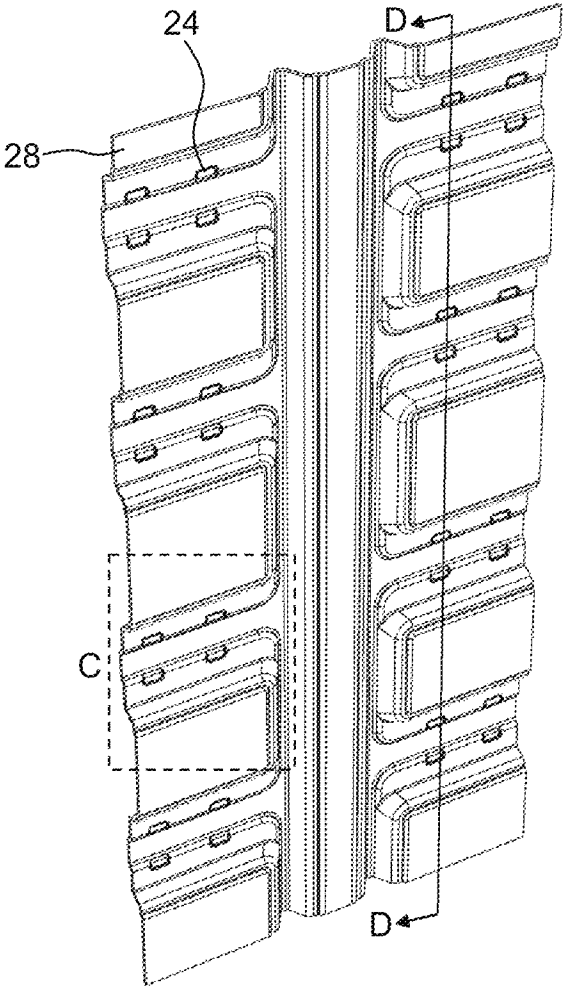
Figure 6J:
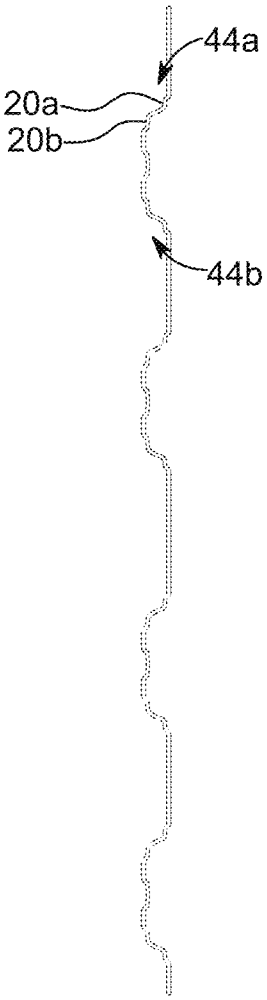
FIGS. 6H and 6J respectively show a front perspective view and a side view of a wall panel having indents within the lateral channels according to another embodiment of the invention described herein.
Figure 6I:
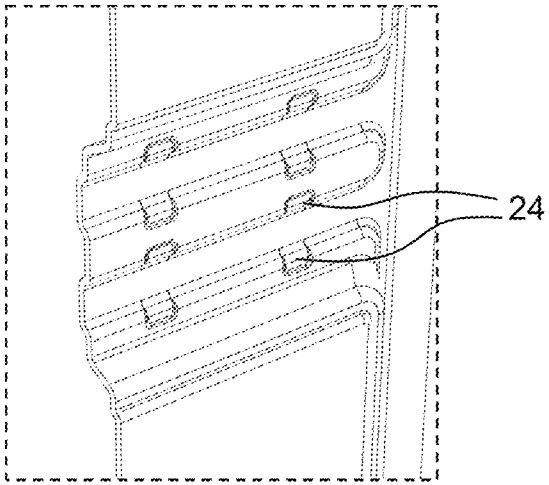
FIG. 6I shows a detail view of indents in the wall panel shown in FIG. 6H.
Figure 6H:
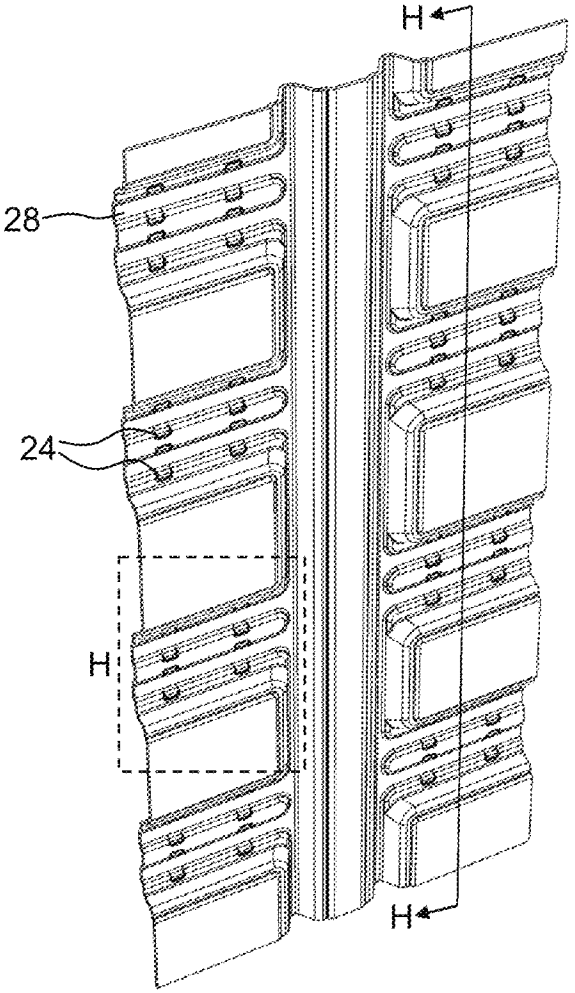

FIGS. 5A-5C show wall modules with bracing strips 94 that span the gaps between channels to create attachment points for panel cover materials such as drywall or other suitable material, specifically for corner conditions where one panel connects perpendicular to an adjacent panel. As shown in FIGS. 5A and 5B, the bracing strips 94 can be small strips or alternatively full width to space the width of a single channel or, as shown in FIG. 5C, full length and full width strips can be span the longitudinal channel 14, sitting on the first step 20*a* on each side of the longitudinal channel 14, to provide a screwing surface for wall cover material such as drywall or the like, as shown in FIGS. 5D-5E. Additionally, these bracing strips 94 can be used outside the described corner conditions between two perpendicular wall segments and to span the lateral or longitudinal channel 14, 16 to create additional attachment surfaces for brackets that allow the placement of plumbing of electrical installations within the open span of a channel. Thus, regardless of size, the bracing strips 94 rest on opposing ledges within the channel proximate to the front face 28 to create a planar front face. The bracing strips 94 can be simple strips of plywood, OSB or other suitable materials or of a specific design and made of wood composites, plastic, or metal.

FIGS. 6A-6D, 6E-6G, and 6H-6J show another inventive aspect of embodiments of the panels 12 described herein wherein sidewalls 42*a*, 42*b*, 44*a*, 44*b* of the channels 14, 16 further include indents 24. The embodiments shown include indents 24 that are equally spaced within each sidewall 42*a*, 42*b*, 44*a*, 44*b*, but it will be appreciated that indents 24 may be provided in any position within any of the sidewalls 42*a*, 42*b*, 44*a*, 44*b*, independent of other indents within the other sidewalls. However, in the preferred embodiment, when an indent is provided within one sidewall a corresponding indent will also be provided in the opposite sidewall with the indents being positioned directly across from one another, such as particularly shown in FIG. 15C. Regardless of location, the indent 24 includes an indent face 52 that is recessed an indent distance from the sidewall of the channel 14, 16 in which the indent 24 is situated. Opposing sidewalls 54*a*, 54*b* span the indent distance and connect the indent face 52 to the corresponding sidewall and are spaced from one another by the indent width. Each of the indent sidewalls 54*a*, 54*b* and face 52 include a top edge 56 and indent bottom edge 58 spaced by an indent depth that is no greater than the channel depth.

In the preferred embodiment shown in FIGS. 6A-6D, the top edge 56 of the indent 24 connects to the front face 28 of the panel 12 and the bottom edge 58 of the indent connects to the first step 20*a*, such that the indent depth is equal to the first step depth. However, alternative embodiments not shown may have indents that have a depth greater than the first step depth while still other embodiments have indents at a depth that is less than the first step depth. Further still, other embodiments may have indents that are altogether removed from the front face 28 of the panel 12 and instead form a slot within the sidewall of the channel, between the corresponding proximal and distal ends, with the indent depth between the top end and the bottom end being any distance that is less than or equal to the overall depth of the channel.

The primary function of the recessed indents 24 is to provide predetermined locations for various kinds of standard or specialty mounting brackets and/or clips used for electrical and plumbing fixtures to provide fixed, code compliant attachment points at the correct height or latitude, such as j-boxes, switches, receptacles, shower valves, shower thermostats, control valves, wall mounted showerheads, hand showers, corner stop valves, utility points for washers and dryers and wall mounted faucets or the like, as shown in FIGS. 15B-E. In addition, standard brackets used in stud frame construction are customarily screwed to the front face of a stud, which results in an uneven attachment surface for wall coverings such as drywall or plywood or the like because both the bracket and the attachment screws protrude past front facing stud surface. It is critical for other subsequent trades, such as drywallers, tile layers and carpenters, to have perfectly level, plumb and square wall surfaces to be able to do their installs efficiently and at a high quality. By recessing these brackets from the front face 28 of the panel 12, uneven surfaces are eliminated as the bracket and screws do not stick out past the front face 28 of the corrugated panel, thus speeding up the work and quality of consecutive trades as walls do not have to be floated by drywallers or tile layers to overcome these imperfections in order to provide straight, plumb and square walls for laying out tiles, and for carpenters for installing kitchen cabinets, without having to shim and adjust the cabinets. This increases efficiency and build quality and reduces labor time and therefore construction cost while increasing building speed.

FIGS. 7A-7D show another inventive aspect of embodiments of the panels 12 described herein wherein the front face 28 includes a recessed section 26 at a corner of the panel 12. Similarly, FIGS. 8A-8F show alternative embodiments of panels 12 with recessed corner sections 26. The recessed section 26 is preferably on the bottom corners, as discussed below and shown in the drawings, but it will be appreciated that the recessed sections 26 could also be at the top corners of the panel 12. Regardless of the particular embodiment, the recessed section 26 includes a recessed face 60 spaced a recessed depth from the front face 28 of the panel 12 and is partially bound by a section sidewall 62 spanning the depth between the front face 28 and the recessed section 26. The recessed section 26 is open to at least a portion of the bottom end of the panel 12 and another portion of one of the side ends of the panel 12. Thus, the recessed face 60 is positioned on the corner of the panel 12 and bound by the sidewall and the end portions of the panel 12. The recessed depth can vary depending on panel design, including being less than the depth of lateral and longitudinal channel 14, 16 as shown in FIG. 8A, equal to the lateral channel depth as shown FIG. 8B or greater than the lateral or longitudinal channel depth in some embodiments. As shown in FIG. 8G, the recessed front facing corner areas of the panel 12 increase the space and grant access closer to the center area of a wall module, which is needed to access the bottom and top plates of an assembled wall module for attaching the wall module to the foundation, via customarily used anchor bolts or structural tie-downs. As shown in FIG. 8H, these recessed corner sections also provide additional installation space and mounting surfaces for plumbing and electrical fixtures that are customarily located at the top and bottom end of the panel 12, like corner stop valves, or J-boxes for supplying electricity to modern style "wash-let" toilets.

Figure 7C:
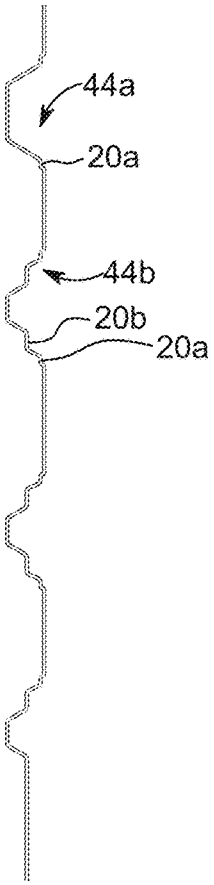
FIGS. 7B, 7C, and 7D respectively show a detail view, a side section view and a bottom section view of portions of the wall panel shown in FIG. 7A.
Figure 7D:
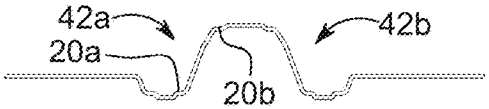
Figure 7B:
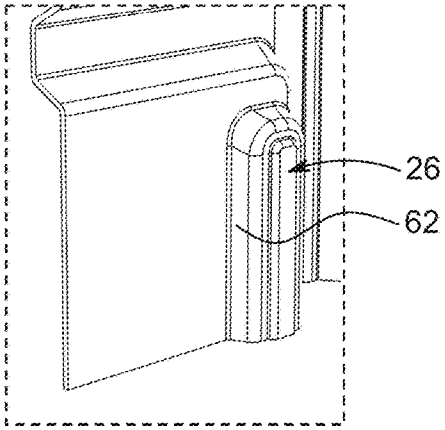
Figure 7A:
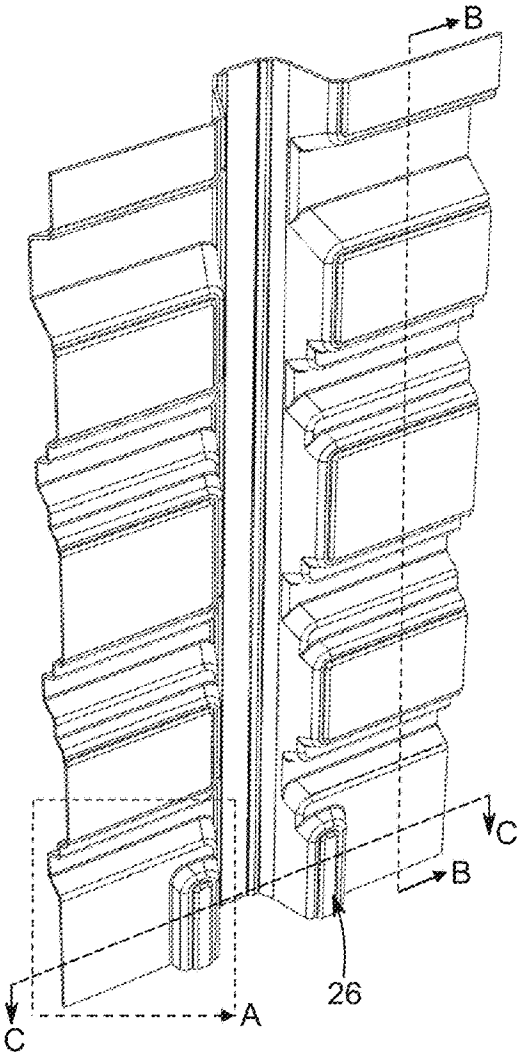
FIG. 7A shows a perspective view of a wall panel having a recessed section according to another embodiment of the invention described herein.
Figure 8C:
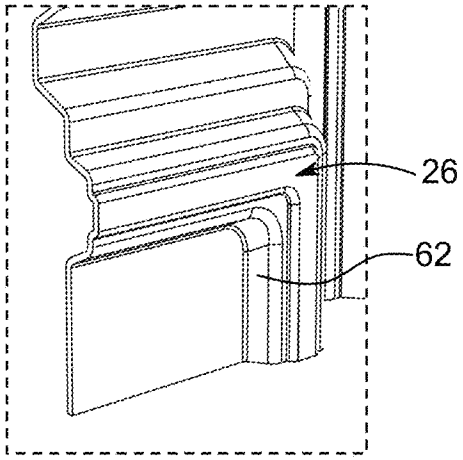
FIGS. 8A-8F are detail perspective views of alternative embodiments of a recessed sections within wall panels according to embodiments of the invention described herein.
Figure 8F:
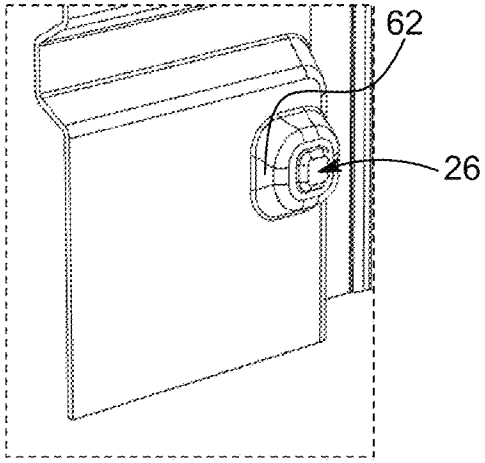
Figure 8B:
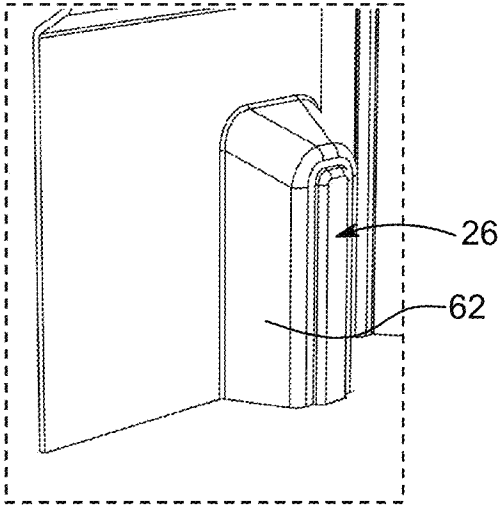
Figure 8E:
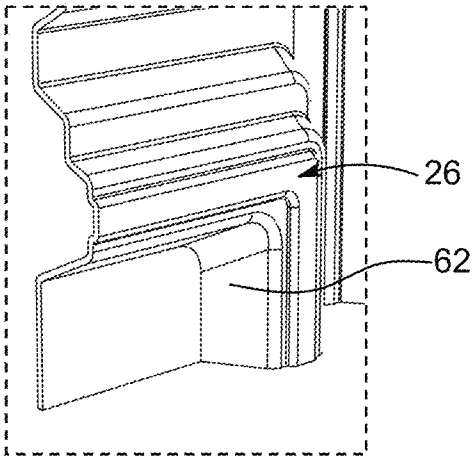
Figure 8A:
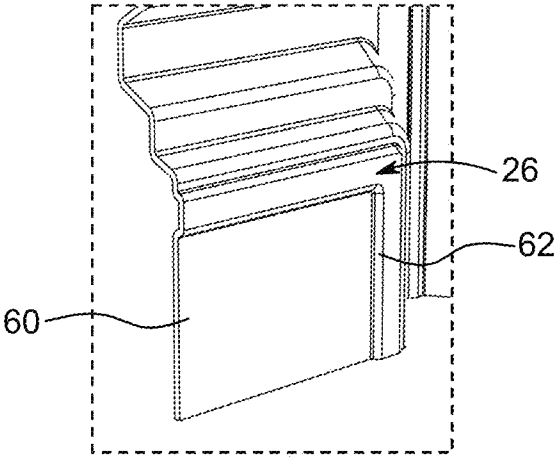
Figure 8D:
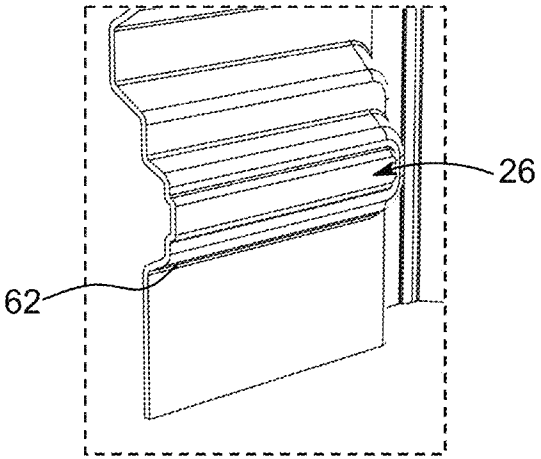
Figure 8H:
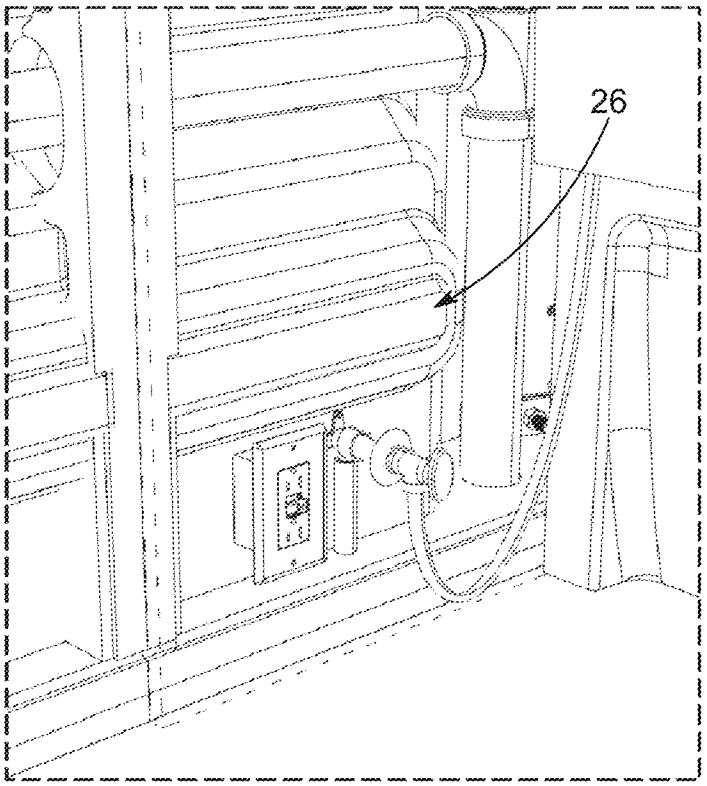
FIGS. 8G and 8H are detail perspective views of alternative embodiments of an installed panel with recessed sections according to embodiments of the invention described herein.
Figure 8G:
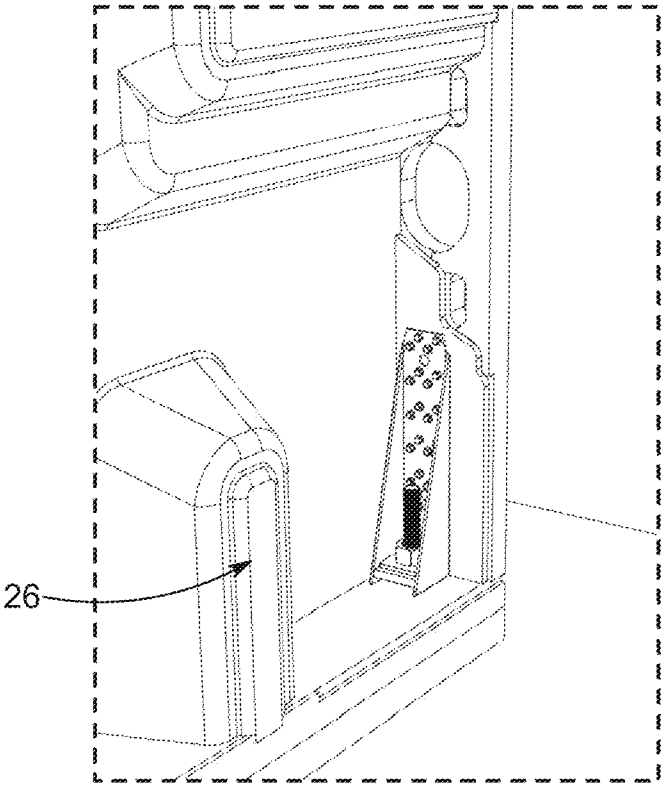

In the embodiment shown in FIGS. 7B, 8B and 8D, the section sidewall 62 may be straight and only bound a portion of one side of the recessed face 60, opposite from the side end of the panel 12 in FIGS. 7B and 8B and opposite from the bottom end of the panel 12 in FIG. 8D. Alternatively, the section sidewall 62 can have an "L" shape be on multiple sides of the recessed face 60, opposite from the top or bottom end and the side end of the panel 12 as shown in FIGS. 8A, 8C and 8E. Furthermore, as shown in FIG. 8F, the section sidewall 62 may not extend to either edge of the panel 12 and instead by free standing within the recessed section 26. As shown in FIG. 8B, the sidewall 62 may also be broken with the lateral channel 16 interrupting the sidewall 62. The recessed section 26 therefore provides front facing corners at the panel corners, creating a planar surface which sits deeper than the panel front face 28.

As discussed with reference to the transitions between the front face 28 and proximal ends of each channel above, the transition between the recessed section 26 in the front face 28 and the channel sidewalls are also devoid of a shear sharp corner and instead have a curved section with a curved corner.

Furthermore, the steps 20 within the sidewalls 42*a*, 42*b*, 44*a*, 44*b* of the channels 14, 16 continue within the recessed section 26 when aligned therewith. FIG. 8B shows an example of a recess sidewall 62 with a first step proximate to the front face 28 while FIGS. 8C-8E show recess sidewalls with multiple steps according to the inventive aspects discussed herein. Alternatively, as shown in FIG. 8A, the recessed section 26 can have the same depth as the first step and therefore form the step portion of the first step.

The function of the recessed section 26 is to create improved access to the top or bottom plate, for attaching the plate or wall assembly to the floor, installing structural hold-downs, as shown in FIG. 8G, as well as creating additional installation space for plumbing installations typically found in proximity to the bottom end of a wall, like a mounting surface for the install of corner vales and or j-boxes for toilets, as shown in FIG. 8G.

Figure 9B:
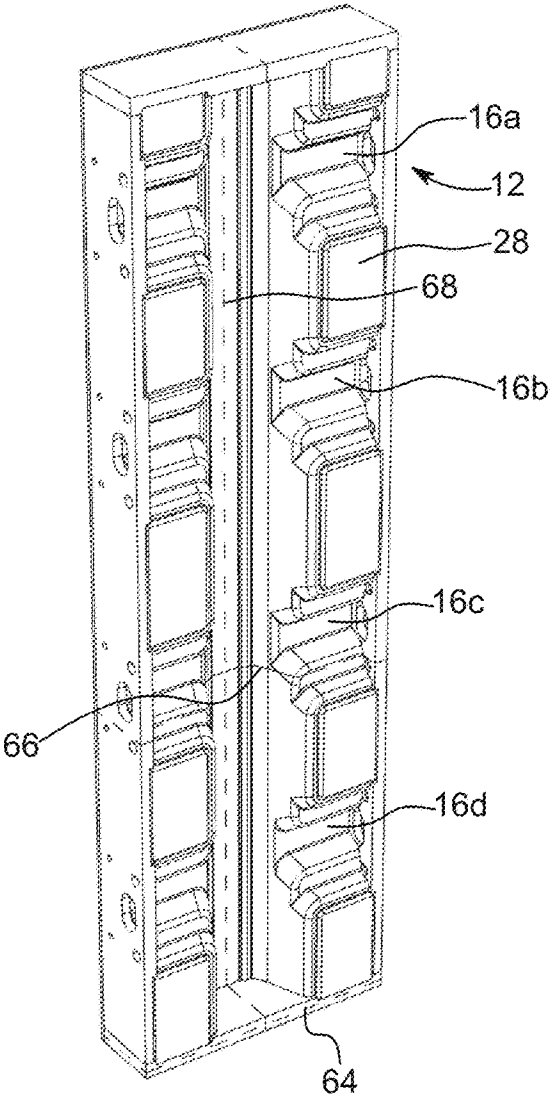
FIGS. 9A and 9B each show perspective views of wall panels with installation indicia according to embodiments of the invention described herein.
Figure 9A:
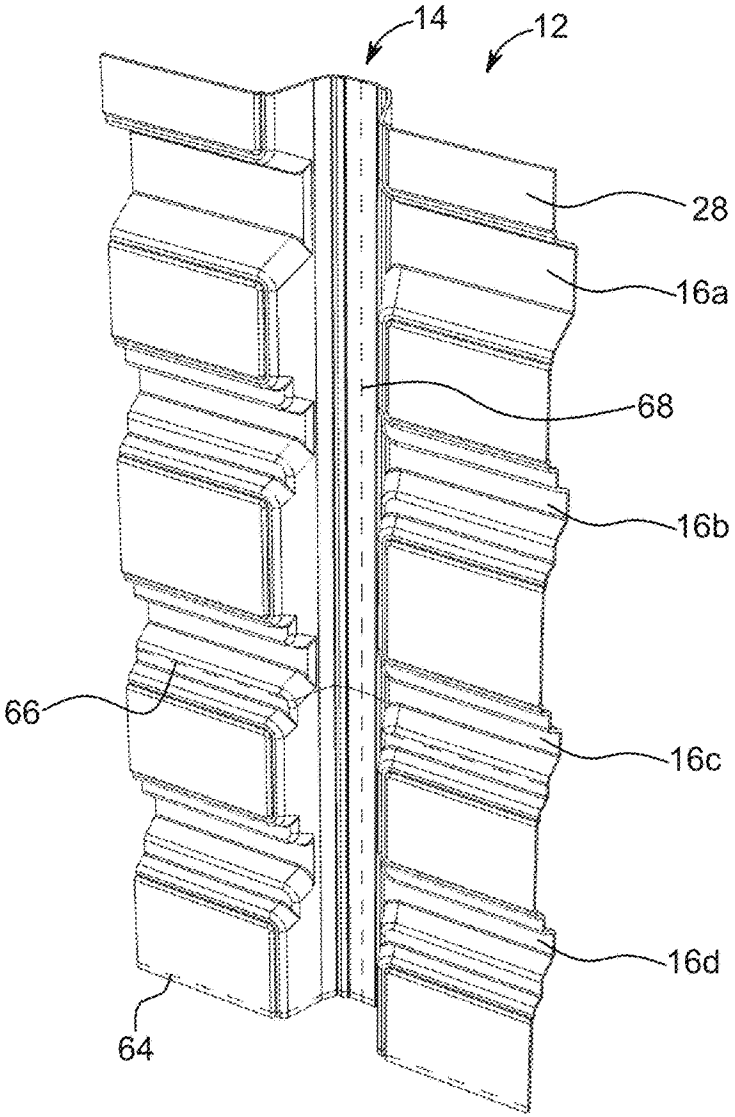
Figure 10B:
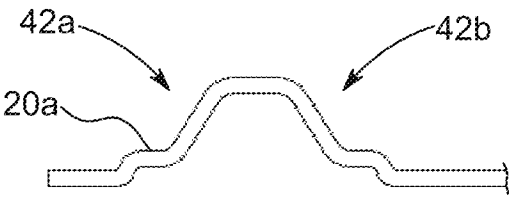
FIGS. 10B and 10C respectively show top section views and a detail view of portions of the wall panel shown in FIG. 10A.
Figure 10C:
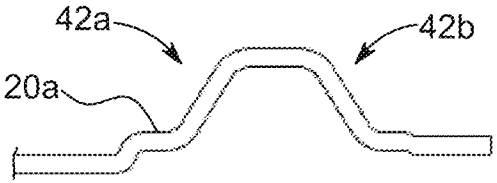
Figure 10D:
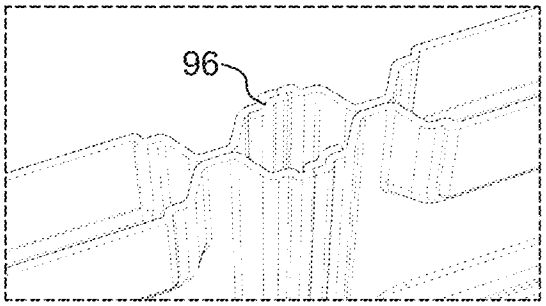
FIG. 10D is a detail perspective view of the connected wall panels shown in FIG. 10A.
Figure 10A:
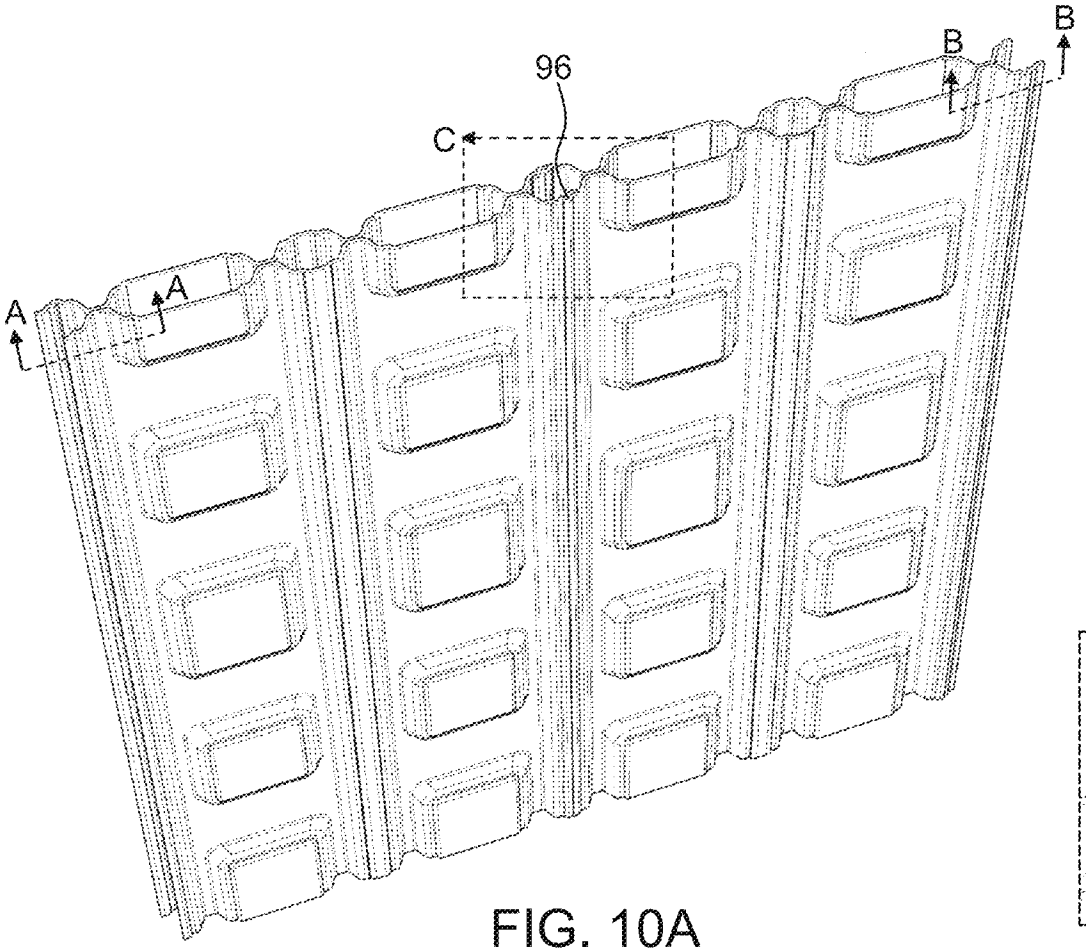
FIG. 10A shows a perspective view of a wall system with connected wall panels according to another embodiment of the invention described herein.

FIGS. 9A and 9B show indicia marked on the front face 28 of the panel 12 to assist with installation. The indicia can be either printed, stenciled, debossed, embossed, milled or engraved on the front face 28 of the corrugated panel 12 and follows the full panel contour. The floor line 64 is proximate to the bottom end of the panel 12 and extends across the width of the panel 12. The height marker 66 is parallel to the floor line and extends across the width of the panel 12 at a consistent distance from the floor line 64. In the preferred embodiment, the vertical center line 68 is centered between the sidewalls of the longitudinal channel 14 and extends across the height of the panel 12. However, the centerline 68 could be on the front face 28 of the channel or at another location within the longitudinal channel 14 in embodiments where the longitudinal channel 14 is not centered on the panel 12. As shown in FIG. 9A, the floor line 64 can be either on the panel 12 itself or, as shown in FIG. 9B, positioned on the surround frame in an alternative embodiment. The distances from the floor line 64 to the respective lateral channels 16 are known whereas the distance of the floor line 64 to the bottom end of the panel may vary based on the subfloor buildup. It will be appreciated that the panel may have, either in addition to or in lieu of, machine readable and/or scannable indicia. For example, the panel may have barcodes, QR codes, and/or non fungible tokens (NFTs).

Although the particular features discussed herein within each panel 12 are inventive, the wall system 10 made up of multiple panels is also inventive. FIGS. 10A-10D show one such innovation of the collective wall panels 12 that adjoin with a lap joint 96 according to one embodiment. In this embodiment, one of the side ends of the panel 12 is flush with the front face 28 while the opposing side end is stepped back a distance from the front face 28. The step back distance is at least as great as the panel's material thickness, but less than the second step depth, such that the stepped back portion of one panel is received by the flush portion of the adjacent panel to create a step joint.

Figure 11C:
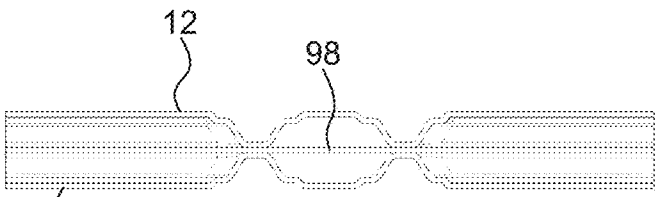
FIGS. 11A-11C respectively show a front perspective view, a side view and a top view of a wall system with connected panels according to another embodiment of the invention described herein.
Figure 11B:
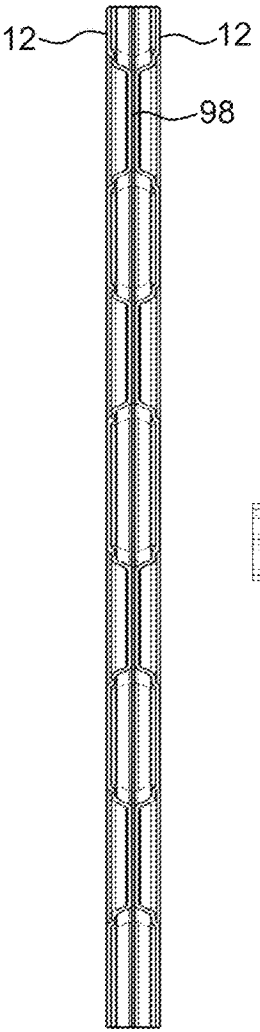
Figure 11A:
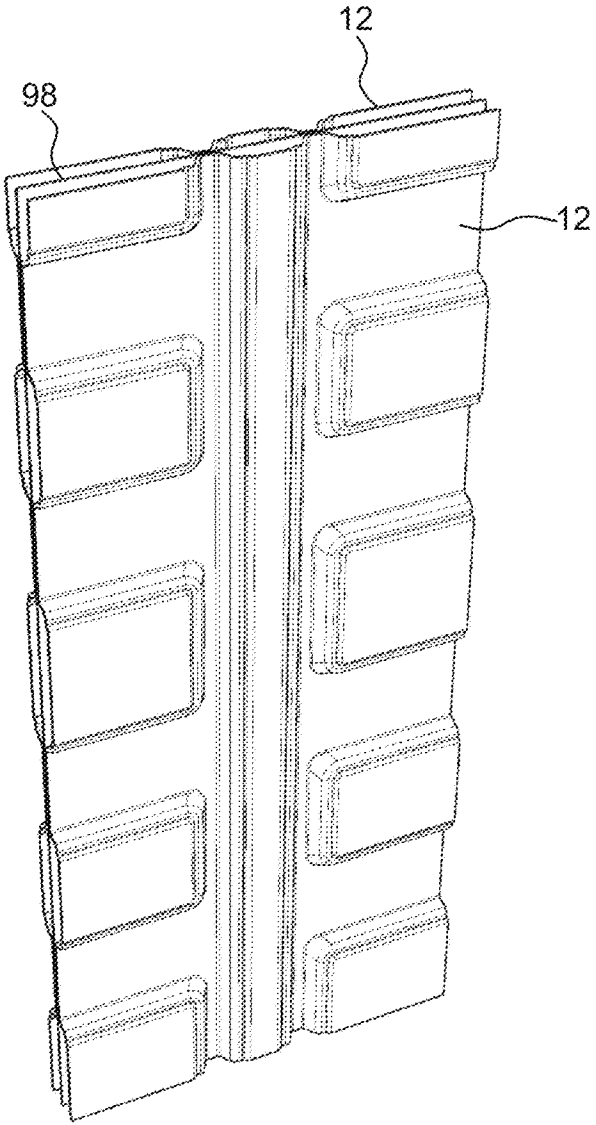

FIGS. 11A-11C show a wall system made of two mirrored panels 12 as described herein and a straight panel 98 between the panels 12. The back faces 30 of the corrugated panels are attached to the frontside and the backside of a straight panel 98, creating a three layer sandwich. The purpose of the straight panel 98, which is centered between two mirrored panels 12 is to increase shear strength to the corrugated panel sandwich.

Figure 12C:
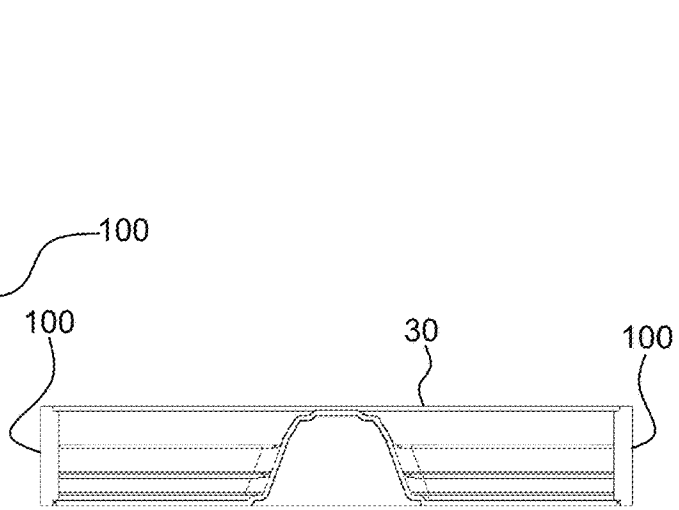
FIG. 12C shows a top section view of the wall system shown in FIG. 12A.
Figure 12B:
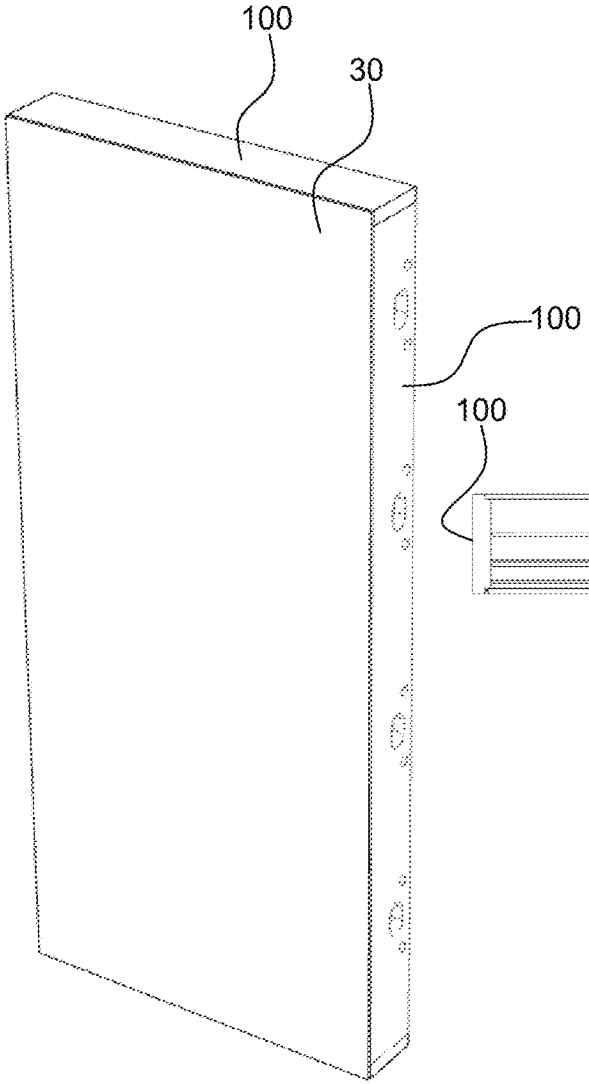
FIGS. 12A and 12B respectively show front and back perspective views of a wall system with connected panels according to another embodiment of the invention described herein.
Figure 12A:
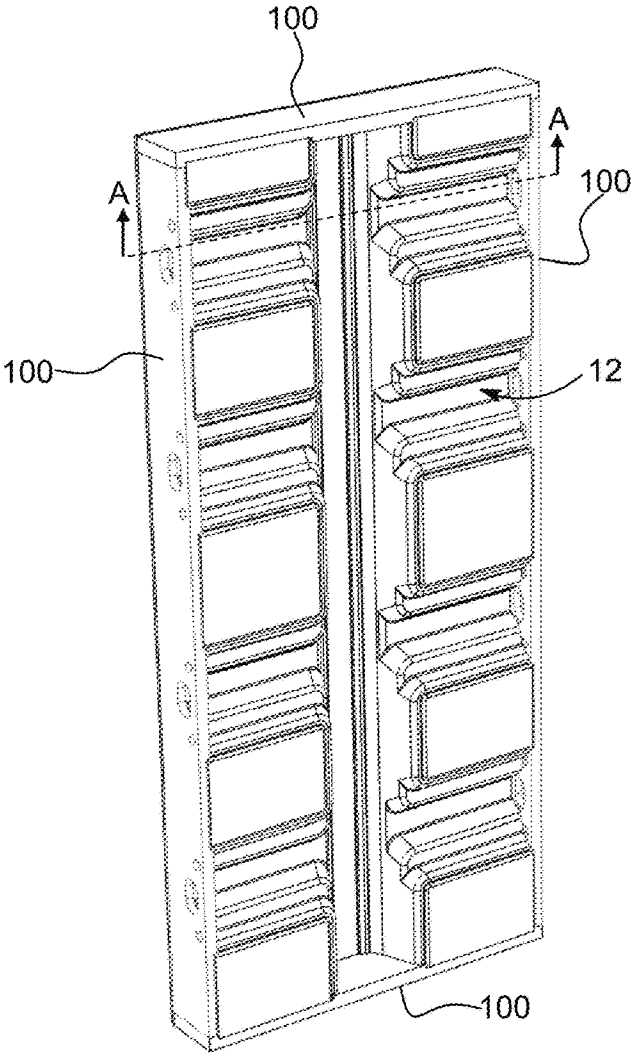
Figure 13C:
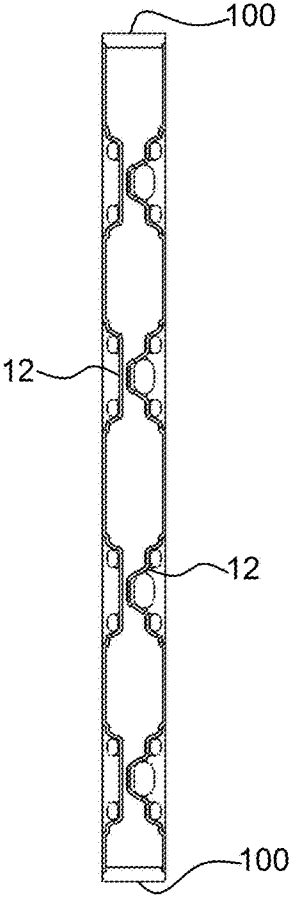
FIGS. 13C and 13D respectively show side and top section views of the wall system shown in FIG. 13A.
Figure 13D:
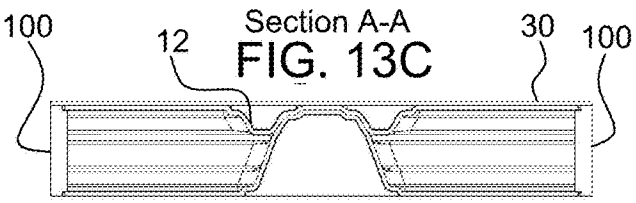
Figure 13B:
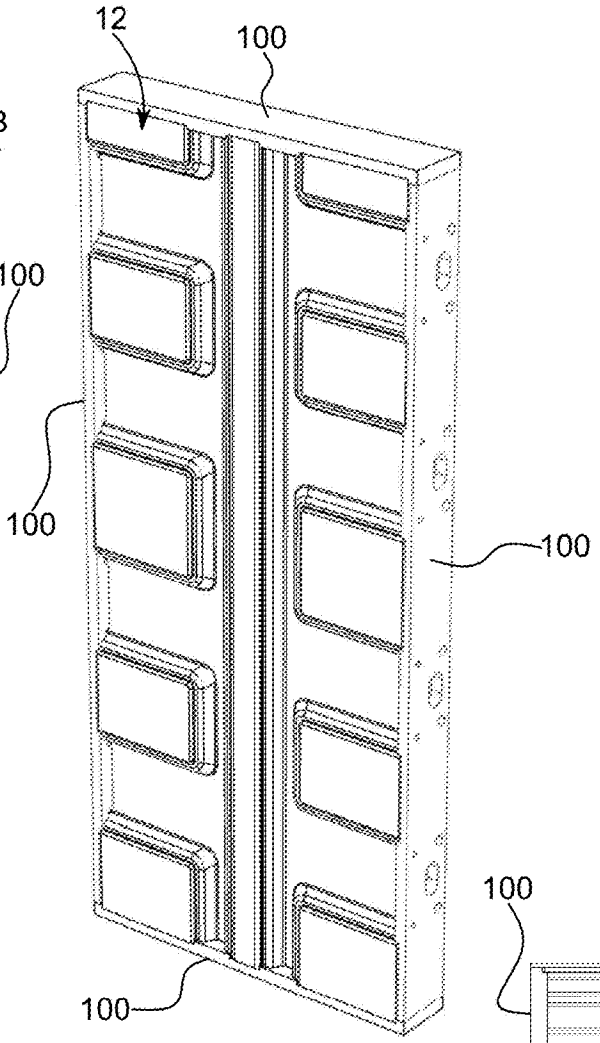
FIGS. 13A and 13B respectively show front and back perspective views of a wall system with connected panels according to another embodiment of the invention described herein.
Figure 13A:
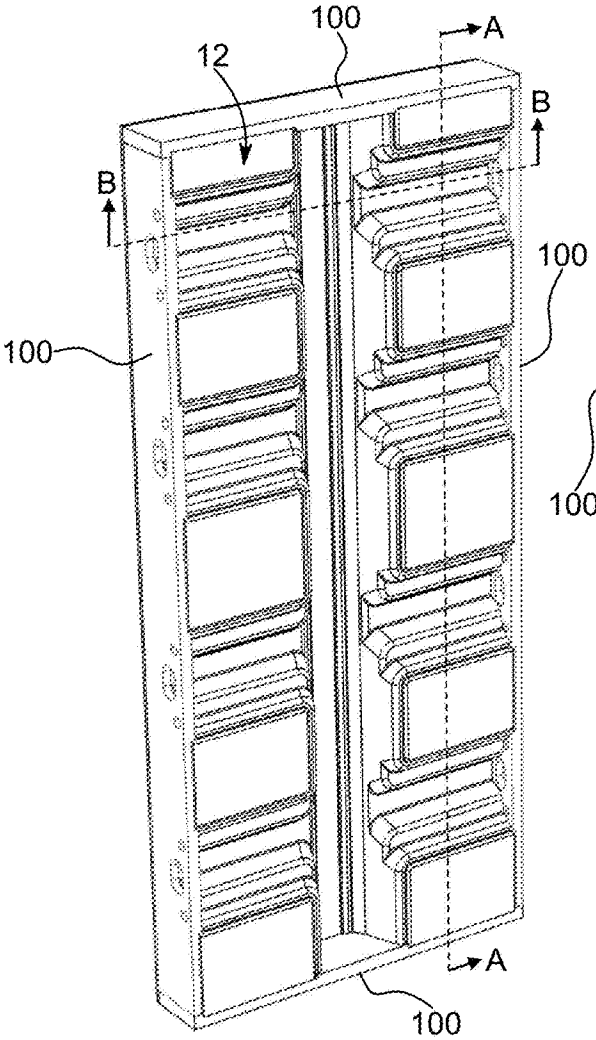

FIGS. 12A-12C show an alternative wall system with a wall panel sandwiched against a flat panel on the corrugated panel's back face and frame 100 with contour milled plates and studs featuring slots mirroring the panel's bottom, top, and side ends. The perimeter edges of the panel are thereby received within the milled portions of the frame 100 that has apertures aligned with each channel, allowing multiple panels to be adjoined with standard framing techniques.

FIGS. 13A-13D show an alternative wall system with a wall panel sandwiched against another panel as a wall module with negative channels and contour milled plates and studs featuring slots mirroring the panel's bottom, top, and side ends. The perimeter edge of the panel are thereby received within the milled portions of the frame 100 that has apertures aligned with each channel, allowing multiple panels to be adjoined with standard framing techniques. Furthermore, installations can be made in both the front and back of the wall assembly.

Figure 14B:
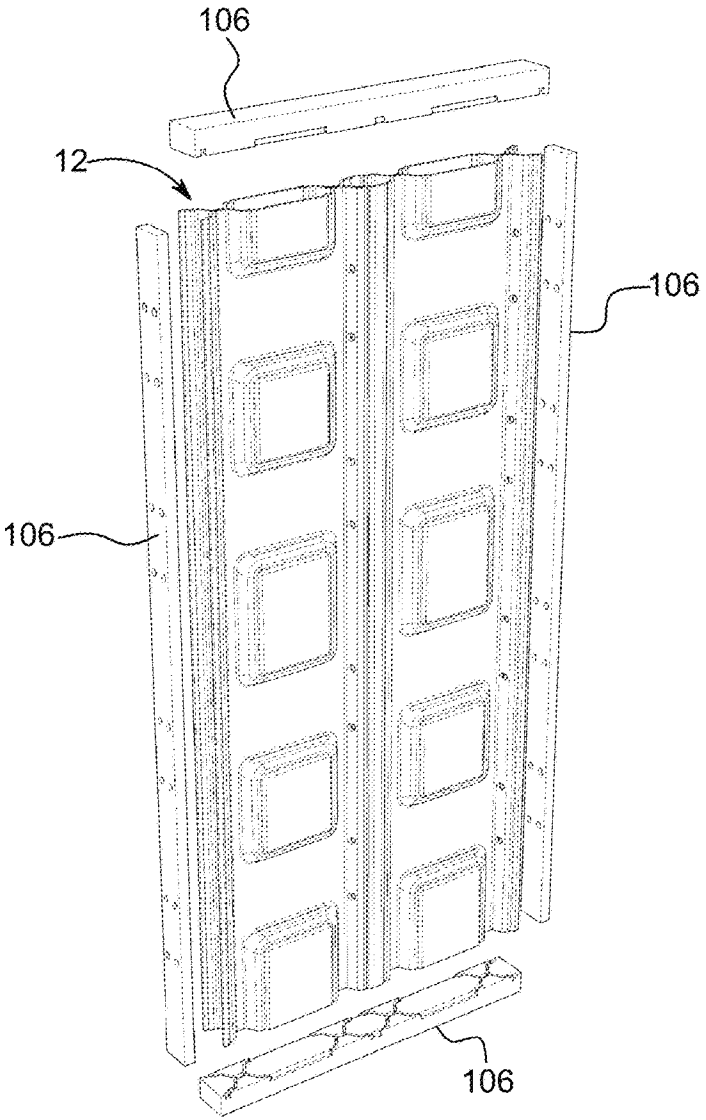
FIGS. 14A and 14B respectively show partial exploded views of wall panels and perimeter tracks of a wall system with connected panels according to another embodiment of the invention described herein.
Figure 14A:
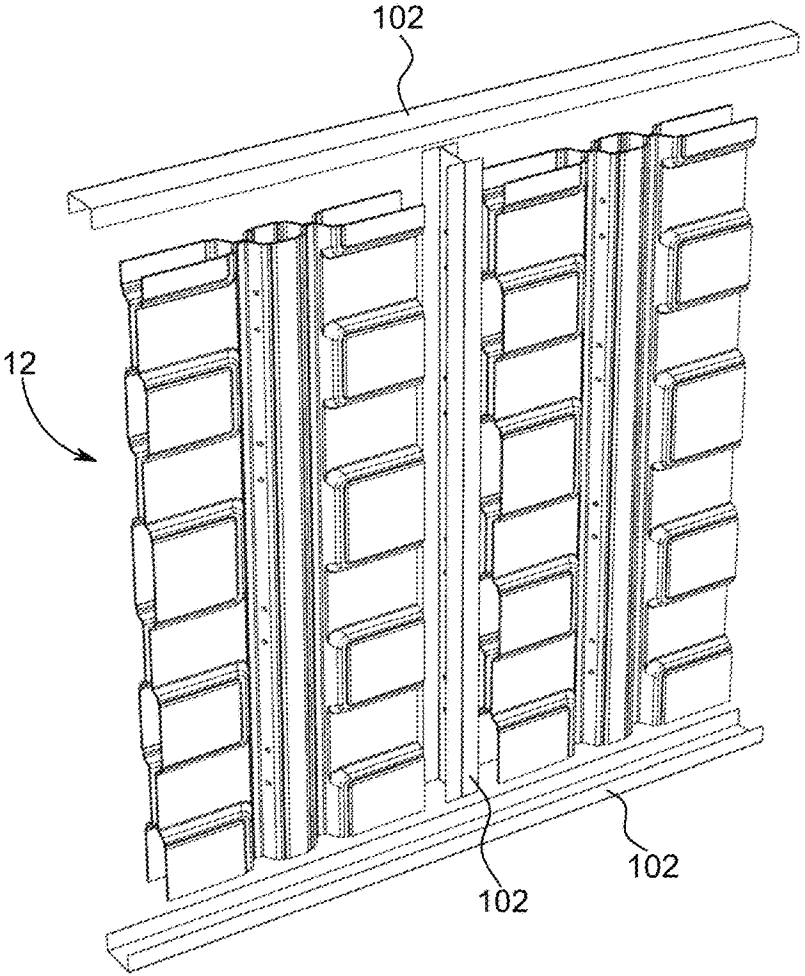

FIGS. 14A and 14B respectively show alternative embodiments of panel connectors 102 used with FIG. 14A showing a C-track that attaches to the top and bottom of the panels 12 and an H-track that connects the sides of adjacent panels 12. Alternatively, the milled connector studs in FIG. 14B show contour milled studs featuring slots which mirror the contours of the panel side ends as well as apertures within the panels 12 and studs. Preferably, the embodiments shown in FIGS. 14A and 14B are a pair of adjacent wall modules in which each wall module is made from a sandwich panel with two (2) mirrored corrugated panels in which the back sides of the vertical channels touch each other. Also, the sloped sidewalls of the longitudinal channel could include apertures.

As indicated above, the present invention encompasses alternative configurations of wall panels 12 and assemblies that have various arrangements of the innovative channels. One assembly may have panels 12 that mirror each other, but it will be appreciated that the double-sided assemblies could have asymmetric corrugated panels and could have corrugated panels with complementary shapes without exactly mirroring each other. Of course, assemblies with panels that symmetrically mirror each other can come in a variety of different shapes. Additionally, for wall panel assemblies with asymmetric corrugated panels that have lateral and longitudinal channels 14, 16 on only one side of the panel assembly, adjacent wall panel assemblies can alternate the direction that they face so that components and other fixtures can be available on both sides of an internal wall.

Insulation within the channels could be made of various materials such as synthetic foams (polyurethane, polystyrene, or polyethylene), various mineral oil based foams, or a variation of plant fiber based products which could be bound through various glues or biological adhesion such as natural resins or mushroom based products, as well as blow-in insulation such as rockwool, fiberglass, or cellulose, recycled denim, sheep wool, hemp wool or wood fiber insulations, as well as cast hempcrete or other sustainable pre molded materials. The lightweight materials for the wall panel assembly can be installed to create a wall by one or two individuals, depending on the particular size of the panels being installed. According to another aspect of the invention described herein, panels are made of any strand-based material or longer plant fiber-based or any anisotropic natural materials are coated with an adhesive prior to being formed into a multi-layered strand mat, with overlapping strands that are oriented in varying directions. The preferred adhesives which hold the strands together are preferably Methylene Diphenyl Diisocyanate (monomeric MDI) and polymeric MDI (PMDI) specifically, because of its excellent properties to bond strands using smaller amounts of adhesive compared to other adhesive systems, as well as its superior strength and resistance to moisture exposure. Furthermore, PMDI is free of unhealthy formaldehyde emissions. Alternatively, Urea-Formaldehyde, Melamine-Formaldehyde, Melamine-Urea-Formaldehyde, Phenol-Formaldehyde, Phenol-Resorcinol-Formaldehyde (PRF), One-Component Polyurethanes (PURs) adhesives or a combination of adhesives can be used. Alternatively, also new renewable, bio-based and synthetic wood polymeric adhesives may be used to bond the wood-based strands, particles or wafers together.

This strand mat is multiple times thicker than the material thickness of the finished corrugated panel and customarily has a continuous thickness. It will be appreciated, that the strand mat or particle mat may have zones, where the mat thickness may vary and, that the pressed panel itself may also feature different regions with varying material thicknesses. Specifically, in areas which are in similar orientation but are not in the same plane as the front face 28 of the panel 12, the panel material thickness may increase, with increasing distance of said surface relative to the front face 28 of the panel 12, where the material thickness at front face 28 of the panel 12 might be slimmer than the material thickness at the back face 30 of the panel 12. Accordingly, the panels are organic-based composite structure that (is) maybe preformed before being pressed into a particular shape having the various inventive aspects described herein. It will be appreciated, that the panels could also be vacuum formed out of suitable thermoplastics, where the material thickness of the front face and the back face of the panel would be similar, but the material thickness of the sloped sidewalls would be less than the material thickness of the front most and rear most facing surfaces.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the panels have been described as they would be used as part of a wall system, it will be appreciated that the panels are structural and can be generally referred to as building panels and that they could also be used as floor panels. Thus, the breadth and scope of the present invention should not be limited by any of the above-described exemplary embodiments, but should be defined only in accordance with the following claims appended hereto and their equivalents.

What is claimed is:

1. A wall system, comprising:

a panel comprising a front face, a back face, a top end, a bottom end and a pair of opposing side ends, wherein the top end and bottom end are spaced by a panel height, wherein the pair of opposing side ends are spaced by a panel width, and wherein the front face and the back face are spaced by a panel total thickness;

a longitudinal channel recessed a longitudinal channel depth from the front face of the panel, wherein the longitudinal channel spans the panel height between the top end and the bottom end;

a plurality of lateral channels recessed a lateral channel depth from the front face of the panel, wherein the lateral channels spans the panel width between the opposing side ends, wherein each of the longitudinal channel and the lateral channels further comprise a trough between a pair of opposing sidewalls spaced by a channel width, wherein the opposing sidewalls are comprised of opposing longitudinal sidewalls and opposing lateral sidewalls, wherein each of the sidewalls span the corresponding channel depth between a sidewall proximal end connected to the front face and a sidewall distal end connected to the respective trough, and wherein the front face is comprised of a flat surface bounded by the longitudinal channel and the lateral channels;

a first step recessed a step depth from the front face within each of the opposing sidewalls, wherein the step depth is less than one half the corresponding longitudinal channel depth, and wherein the step depth is less than five times a material thickness of the panel; and a plurality of channel transitions between the longitudinal channel and the lateral channels, a plurality of proximal sidewall transitions between the respective proximal ends of each sidewall and the front face of the panel, and a plurality of distal sidewall transitions between the respective distal ends of each sidewall and the corresponding troughs, and wherein each of the channel transitions, the proximal sidewall transitions, and the distal sidewall transitions comprise a curved section devoid of a sharp corner.

2. The wall system of claim 1 further comprising a second step, wherein the second step is recessed a second step depth from the front face within at least one of the opposing longitudinal sidewalls and the opposing lateral sidewalls, and wherein the second step is positioned at a location between the first step and one of the corresponding longitudinal troughs and the corresponding lateral troughs.

3. The wall system of claim 1 further comprising at least one of a human readable indicia on the panel, a machine readable indicia on the panel, and a recessed section, wherein the recessed section is within at least one of the opposing longitudinal sidewalls and the opposing lateral sidewalls, wherein the recessed section is within the panel proximate to at least one of the bottom end and the top end, wherein a first indicia of the human readable indicia laterally extends between the opposing side ends of the panel along a first path located proximate to the bottom end, wherein a second indicia of the human readable indicia laterally extends between the opposing side ends of the panel along a second path located between the first indicia and the top end of the panel, wherein a third indicia of the human readable indicia longitudinally extends along a third path located between the opposing side ends, and wherein the machine readable indicia is comprised of at least one of a barcode, a QR code, and a non fungible token.

4. The wall system of claim 1, wherein the curved sections of each of the plurality of channel transitions further comprise a radius of curvature, wherein a curve:thickness ratio between the radius of curvature and a material thickness of the panel is within a range between 0.5:1 and 20:1, inclusive.

5. The wall system of claim 1, wherein the opposing longitudinal sidewalls comprise a straight longitudinal sidewall section between the channel transitions, and wherein the opposing lateral sidewalls comprise a straight lateral sidewall section between the channel transitions.

6. The wall system of claim 4, wherein the plurality of channel transitions further comprises a group of proximal transitions and least one of a group of distal transitions and a group of middle transitions, wherein the group of proximal transitions intersect a proximal longitudinal plane between the front face and the back face of the panel that is more proximate to the front face of the panel, wherein the group of distal transitions intersect a distal longitudinal plane between the front face and the back face of the panel that is more proximate to the back face of the panel, wherein the group of middle transitions intersects a middle longitudinal plane between the proximal longitudinal plane and the distal longitudinal plane, wherein the radius of curvature of the group of distal transitions is greater than the radius of curvatures of the group of proximal transitions and equal or greater to the radius of curvatures of group middle transitions, and wherein the radius of curvatures of the middle transitions is equal or less than the radius of curvatures of the group of distal transitions and greater than the radius of curvatures of the group of proximal transitions.

7. A wall system, comprising:

a panel comprising a front face, a back face, a top end, a bottom end and a pair of opposing side ends, wherein the top end and bottom end are spaced by a panel height, wherein the pair of opposing side ends are spaced by a panel width, and wherein the front face and back face are spaced by a panel total thickness;

a longitudinal channel recessed a longitudinal channel depth from the front face of the panel, wherein the longitudinal channel spans the panel height between the top end and the bottom end;

a plurality of lateral channels recessed a lateral channel depth from the front face of the panel, wherein the lateral channel spans the panel width between the opposing side ends, wherein the longitudinal channel and the lateral channels respectively comprise a longitudinal trough and a lateral trough between a pair of corresponding opposing sidewalls spaced by a channel width, and wherein each of the opposing sidewalls span the corresponding channel depth between a sidewall proximal end connected to the front face and a sidewall distal end connected to the respective longitudinal trough and the respective lateral trough; and a first step recessed a step depth from the front face within each of the opposing sidewalls, wherein the step depth is less than one half the corresponding longitudinal channel depth and the lateral channel depth spanned by the corresponding opposing sidewalls.

8. The wall system of claim 7 further comprising a plurality of channel transitions between the longitudinal channel and the lateral channels, a plurality of proximal sidewall transitions between the respective sidewall proximal ends of each sidewall and the front face of the panel, a plurality of distal sidewall transitions between the respective distal ends of each sidewall and the corresponding longitudinal trough and the corresponding lateral trough, a plurality of step transitions between the first step and the corresponding opposing sidewalls, and wherein each of the channel transitions, the proximal sidewall transitions, the distal sidewall transitions, the step transitions comprise a curved section devoid of a sharp corner.

9. The wall system of claim 8, wherein the opposing sidewalls are comprised of opposing longitudinal sidewalls and opposing lateral sidewalls, wherein the plurality of channel transitions further comprises a group of proximal transitions and least one of a group of distal transitions and a group of middle transitions, wherein the group of proximal transitions intersect a proximal longitudinal plane between the front face and the back face of the panel that is more proximate to the front face of the panel, wherein the group of distal transitions intersect a distal longitudinal plane between the front face and the back face of the panel that is more proximate to the back face of the panel, wherein the group of middle transitions intersects a middle longitudinal plane between the proximal longitudinal plane and the distal longitudinal plane, wherein the curved sections of the group of proximal transitions, the group of distal transitions and the group of middle transitions each comprise a radius curvature, wherein the radius of curvature of the group of distal transitions is greater than the radius of curvatures of the group of middle transitions and the radius of curvatures of group proximal transitions, and wherein the radius of curvatures of the middle transitions is equal or less than the radius of curvatures of the group of distal transitions and greater than the radius of curvatures of the group of proximal transitions.

10. The wall system of claim 7, further comprising a second step recessed a second step depth from the front face within at least one of the opposing sidewalls, wherein the second step is positioned at a location between the first step and one of the corresponding longitudinal trough and the corresponding lateral troughs, and wherein each of the first step and the second step further comprise an inner edge and an outer edge radially spaced a step width.

11. The wall system of claim 10, wherein each of the sidewalls further comprises a first section between the sidewall proximal end and the first step and a second section between the first step and the sidewall distal end, wherein the first step depth is less than five times a material thickness of the panel, wherein the first section spans the first step depth, wherein the second section spans the second step depth, and wherein the second step is positioned within the second section.

12. The wall system of claim 7 further comprising an indent within at least one of the opposing sidewalls, wherein the indent comprises a indent face recessed an indent distance from the sidewall proximal end and a pair of opposing indent sidewalls spanning the indent distance between the sidewall proximal end and the indent face, wherein the opposing indent sidewalls are spaced by an indent width, wherein the indent face spans the indent width, wherein each of the indent sidewalls and the indent face further comprise an indent top edge and an indent bottom edge spaced by an indent depth, and wherein the indent depth is no greater than the corresponding longitudinal channel depth and the corresponding lateral channel depth.

13. The wall system of claim 7, wherein the panel further comprises a recessed section proximate to at least one of the bottom end and the top end, wherein the recessed section comprises a recessed face recessed a section depth from the front face and a section sidewall spanning the section depth between the recessed face and the front face, and wherein the section sidewall is removed from the bottom end and at least one of the side ends of the panel.

14. The wall system of claim 7, wherein the panel further comprises at least one of a human readable indicia and a machine readable indicia, wherein a first indicia of the human readable indicia laterally extends between the opposing side ends of the panel along a first path located proximate to the bottom end, wherein a second indicia of the human readable indicia laterally extends between the opposing side ends of the panel along a second path located between the first indicia and the top end of the panel, wherein a third indicia of the human readable indicia longitudinally extends along a third path located between the opposing side ends, and wherein the machine readable indicia is comprised of at least one of a barcode, a QR code, and a non fungible token.

15. The wall system of claim 7, wherein the lateral channel depth is no greater than the longitudinal channel depth.

16. The wall system of claim 7, wherein the longitudinal trough of the longitudinal channel further comprises a rear longitudinal channel recessed a rear longitudinal channel depth from the back face of the panel within the longitudinal trough, and wherein the rear longitudinal channel spans the panel height between the top end and the bottom end.

17. The wall system of claim 7, wherein the lateral trough of at least one of the lateral channels further comprises a rear lateral channel recessed a rear lateral channel depth from the back face of the panel.

18. The wall system of claim 7, wherein the panel is further comprised of an organic-based composite material comprising a plurality of multi-layer strands and an adhesive between the multi-layer strands.

19. A wall system, comprising:

a panel comprising a front face, a back face, a top end, a bottom end and a pair of opposing side ends, wherein the top end and the bottom end are spaced by a panel height, wherein the pair of opposing side ends are spaced by a panel width, and wherein the front face and the back face are spaced by a panel total thickness;

a longitudinal channel recessed a longitudinal channel depth from the front face of the panel, and wherein the longitudinal channel spans the panel height between the top end and the bottom end;

a plurality of lateral channels recessed a lateral channel depth from the front face of the panel, wherein the lateral channel spans the panel width between the opposing side ends, wherein the longitudinal channel and the lateral channels further comprise a trough between a respective pair of opposing longitudinal sidewalls and pair of opposing lateral sidewalls spaced by a channel width, and wherein each of the sidewalls span the corresponding channel depth between a sidewall proximal end connected to the front face and a sidewall distal end connected to the trough;

a first step recessed a step depth from the front face within each of the opposing longitudinal sidewalls and the opposing lateral side walls; and a second step recessed a second step depth from the front face within at least one of the opposing longitudinal sidewalls and the opposing lateral sidewalls, and wherein the second step is positioned at a location between the first step and one of the corresponding longitudinal troughs and the corresponding lateral troughs.

20. The wall system of claim 19 further comprising a plurality of channel transitions between the longitudinal channel and the lateral channels, a plurality of proximal sidewall transitions between the respective proximal ends of each sidewall and the front face of the panel, a plurality of distal sidewall transitions between the respective sidewall distal ends of each sidewall and the corresponding troughs, a plurality of step transitions between each of the first steps, the second steps and the corresponding opposing sidewalls between the first steps and the second steps, wherein each of the channel transitions, the proximal sidewall transitions, the distal sidewall transitions, the step transitions comprise a curved section devoid of a sharp corner, wherein the plurality of channel transitions further comprises a group of proximal transitions and least one of a group of distal transitions and a group of middle transitions, wherein the group of proximal transitions intersect a proximal longitudinal plane between the front face and the back face of the panel that is more proximate to the front face of the panel, wherein the group of distal transitions intersect a distal longitudinal plane between the front face and the back face of the panel that is more proximate to the back face of the panel, wherein the group of middle transitions intersects a middle longitudinal plane between the proximal longitudinal plane and the distal longitudinal plane, wherein the curved section of the group of proximal transitions, the group of distal transitions and the group of middle transitions comprises a radius of curvature, wherein the radius of curvature of the group of distal transitions is greater than or equal to the radius of curvatures of the group of middle transitions and the radius of curvatures of group proximal transitions, and wherein the radius of curvatures of the group of middle transitions is less than or equal to the radius of curvatures of the group of distal transitions and greater than the radius of curvatures of the group of proximal transitions.

21. The wall system of claim 19, wherein each of the first step and the second step further comprise an inner edge and an outer edge radially spaced a step width, wherein each of the sidewalls further comprises a first section between the sidewall proximal end and the inner edge of the first step and a second section between the outer edge of the first step and the sidewall distal end, wherein the first section spans the first step depth, wherein the second section spans the second step depth, and wherein the second step is positioned within the second section.

22. The wall system of claim 19 further comprising an indent within at least one of the opposing longitudinal sidewalls and the opposing lateral sidewalls, wherein the indent comprises a indent face recessed an indent distance from the sidewall proximal end and a pair of opposing indent sidewalls spanning the indent distance between the sidewall proximal end and the indent face, wherein the opposing indent sidewalls are spaced by an indent width, wherein the indent face spans the indent width, wherein each of the indent sidewalls and the indent face further comprise an indent top edge and an indent bottom edge spaced by an indent depth, and wherein the indent depth is no greater than the corresponding longitudinal channel depth and the lateral channel depth.

23. The wall system of claim 19, wherein the panel further comprises a recessed section proximate to at least one of the bottom end and the top end, wherein the recessed section comprises a recessed face recessed a section depth from the front face and a section sidewall spanning the section depth between the recessed face and the front face, and wherein the section sidewall is removed from the bottom end and at least one of the side end of the panel.

24. The wall system of claim 19, wherein the panel further comprises at least one of a human readable indicia and a machine readable indicia, wherein a first indicia of the human readable indicia laterally extends between the opposing side ends of the panel along a first path located proximate to the bottom end, wherein a second indicia of the human readable indicia laterally extends between the opposing side ends of the panel along a second path located between the first indicia and the top end of the panel, wherein a third indicia of the human readable indicia longitudinally extends along a third path located between the opposing side ends, and wherein the machine readable indicia is comprised of at least one of a barcode, a QR code, and a non fungible token.

25. The wall system of claim 18, wherein the panel is further comprised of an organic-based composite material comprising a plurality of multi-layer strands and an adhesive between the multi-layer strands.

26. The wall system of claim 7, further comprising a plurality of channel transitions between the longitudinal channel and the lateral channels, wherein the channel transitions comprise a curved section devoid of a sharp corner, wherein the opposing sidewalls are comprised of opposing longitudinal sidewalls and opposing lateral sidewalls, wherein the opposing longitudinal sidewalls comprise a straight longitudinal sidewall section between the channel transitions, and wherein the opposing lateral sidewalls comprise a straight lateral sidewall section between the channel transitions.

27. The wall system of claim 19, further comprising a plurality of channel transitions between the longitudinal channel and the lateral channels, wherein the channel transitions comprise a curved section devoid of a sharp corner, wherein the opposing longitudinal sidewalls comprise a straight longitudinal sidewall section between the channel transitions, and wherein the opposing lateral sidewalls comprise a straight lateral sidewall section between the channel transitions.

* * * * *